US011918858B2

(12) United States Patent
Agrawal et al.

(10) Patent No.: US 11,918,858 B2
(45) Date of Patent: Mar. 5, 2024

(54) MECHANICAL APPARATUS FOR HUMAN BALANCE TRAINING

(71) Applicant: Balance T, LLC, Lutherville, MD (US)

(72) Inventors: Yuri Agrawal, Lutherville, MD (US); Michael C. Schubert, Parkton, MD (US)

(73) Assignee: Balance T, LLC, Lutherville, MD (US)

( * ) Notice: Subject to any disclaimer, the term of this patent is extended or adjusted under 35 U.S.C. 154(b) by 48 days.

(21) Appl. No.: 17/165,882

(22) Filed: Feb. 2, 2021

(65) Prior Publication Data

US 2022/0241650 A1 Aug. 4, 2022

(51) Int. Cl.
*A63B 26/00* (2006.01)
*A63B 71/00* (2006.01)

(52) U.S. Cl.
CPC ..... *A63B 26/003* (2013.01); *A63B 71/0054* (2013.01); *A63B 2209/00* (2013.01); *A63B 2225/093* (2013.01)

(58) Field of Classification Search
CPC ... A63B 26/003; A63B 69/38; A63B 23/0464; A63B 1/00; A63B 71/0054; A63B 2209/00; A63B 2225/093; A63B 22/203; A63B 2022/0038; A63B 22/0023; A63B 22/14; A63B 60/0081
See application file for complete search history.

(56) References Cited

U.S. PATENT DOCUMENTS 2,299,683 A * 10/1942 Lester ..... F21V 21/26 248/122.1
2,376,716 A * 5/1945 Odin ..... F16B 7/105 248/407
2,479,720 A * 8/1949 Brandt ..... G03B 15/07 248/123.2
2,921,791 A * 1/1960 Berne ..... A63B 21/015 482/44
3,690,655 A * 9/1972 Chapman ..... A63B 23/14 482/109
3,713,653 A * 1/1973 Romans ..... A63B 23/12 482/44
3,817,483 A * 6/1974 Garvey ..... A45B 5/00 D6/335

(Continued)

*Primary Examiner* — Melba Bumgarner
*Assistant Examiner* — Amir A Klayman
(74) *Attorney, Agent, or Firm* — Morgan, Lewis & Bockius LLP

(57) ABSTRACT

A mechanical apparatus for human balance training includes a cross bar whose center is attached to a pivotable protrusion extending from a leg having a base. The apparatus also includes a slidable sheath surrounding a portion of the leg proximate to the pivotable protrusion. The slidable sheath has a plurality of allowed positions relative to the leg, each position limiting tilt of the cross bar to a respective angular range. In some embodiments, each allowed position limits tilt of the cross bar by controlling an extent by which the pivotable protrusion extends out from the sheath. In some embodiments, the sheath is threaded relative to the leg and the allowed positions are a continuous range adjusted by twisting the sheath relative to the leg. In some embodiments, the allowed positions are predefined locking positions. Each locking position limits tilt of the cross bar to a respective predefined angular range.

20 Claims, 42 Drawing Sheets

(56) References Cited

U.S. PATENT DOCUMENTS 3,982,756 A * 9/1976 Hersey ..... A63B 23/04 482/131
4,047,684 A * 9/1977 Kobayashi ..... G10G 5/00 84/421
4,543,067 A * 9/1985 Wallen ..... G09B 23/10 434/300
4,620,701 A * 11/1986 Mojden ..... A63B 3/00 482/142
4,773,621 A * 9/1988 Gebhardt ..... F21S 6/006 248/122.1
4,925,185 A * 5/1990 Gongwer ..... A63B 23/03525 482/131
4,927,109 A * 5/1990 Wilson ..... E04H 4/10 248/354.3
4,930,839 A * 6/1990 Saito ..... A47C 9/10 248/155.3
5,303,926 A * 4/1994 Owens ..... A63B 69/3621 473/274
5,334,028 A * 8/1994 Melligan ..... A63B 69/3608 473/409
5,449,138 A * 9/1995 Ciancio ..... F21V 21/26 403/53
5,490,825 A * 2/1996 Wilkinson ..... A63B 21/072 482/109
5,518,470 A * 5/1996 Piaget ..... A63B 22/001 482/53
5,538,364 A * 7/1996 Huntsman ..... E21D 15/54 405/303
5,681,107 A * 10/1997 Wang ..... F21V 21/002 439/375
5,685,107 A * 11/1997 Sweet ..... A01K 97/10 43/21.2
5,820,520 A * 10/1998 Sieber ..... A63B 23/0227 482/148
5,833,081 A * 11/1998 Smith ..... B60R 7/10 224/313
5,951,406 A * 9/1999 Steane ..... A63G 11/00 472/111
5,979,854 A * 11/1999 Lundgren ..... E04F 21/1822 248/354.3
6,176,063 B1 * 1/2001 Warin ..... E04F 21/1822 52/749.1
6,244,810 B1 * 6/2001 Reyes ..... E04F 21/1811 414/11
6,381,772 B1 * 5/2002 Dawson ..... A47K 3/022 4/578.1
7,090,626 B1 * 8/2006 Miller ..... A63B 21/4035 482/44
7,143,902 B2 * 12/2006 Iversen ..... B60R 7/10 211/85.3
7,256,338 B2 * 8/2007 Hsieh ..... G10D 13/10 84/421
7,434,772 B1 * 10/2008 Jou ..... F26B 21/001 248/124.2
7,674,185 B2 * 3/2010 Omidi ..... A63B 69/3632 473/223
7,744,046 B1 * 6/2010 Lundy ..... B60R 11/02 248/219.2
8,092,354 B2 * 1/2012 Oller, Jr. ..... A63B 21/4047 482/131
8,122,629 B2 * 2/2012 Cowgill ..... G09F 15/0062 248/166
8,403,408 B2 * 3/2013 Hosler ..... A47C 9/025 297/4
8,425,343 B1 * 4/2013 Olmos ..... A63B 69/3621 473/274
9,295,866 B2 * 3/2016 Kwo ..... A63B 71/023
9,516,400 B1 * 12/2016 Roberts ..... F16M 11/28
9,599,278 B2 * 3/2017 Ruckman ..... E06B 3/5063
9,664,331 B1 * 5/2017 Caputa ..... E05C 17/047
10,137,051 B2 * 11/2018 Ritter ..... A61H 3/02
10,391,011 B2 * 8/2019 Miller ..... F16M 13/027
10,636,397 B2 * 4/2020 Mackey ..... G10G 5/005
10,729,961 B2 * 8/2020 Ohle ..... A63B 69/002
11,147,264 B1 * 10/2021 Reynoso ..... A01M 31/06
11,198,030 B2 * 12/2021 Endelman ..... A63B 21/0557
11,293,586 B1 * 4/2022 Kallas ..... H04R 1/08
2003/0089830 A1 * 5/2003 Loughman ..... F16M 11/10 248/125.7
2005/0181914 A1 * 8/2005 Radkowski ..... A63B 69/004 482/907
2006/0040799 A1 * 2/2006 Pompile ..... A63B 23/1245 482/148
2006/0089239 A1 * 4/2006 Davies, III ..... A61H 1/02 482/148
2011/0167986 A1 * 7/2011 Hennessey ..... G10D 13/063 248/440.1
2013/0112832 A1 * 5/2013 Hilton ..... A47C 21/028 248/354.1
2013/0337945 A1 * 12/2013 Marks ..... A63B 69/0091 473/423
2014/0082992 A1 * 3/2014 Mettler ..... A01M 31/06 43/2
2015/0102187 A1 * 4/2015 Hennessey ..... F16M 11/10 403/103
2015/0111706 A1 * 4/2015 Broadhurst ..... A63B 21/0085 482/72
2015/0313726 A1 * 11/2015 Beverland ..... A61B 17/1746 606/86 R
2015/0352420 A1 * 12/2015 Sharp, Jr. ..... A63B 69/0053 473/439
2016/0255823 A1 * 9/2016 Thomas ..... A01K 97/10
2017/0282041 A1 * 10/2017 Chiles ..... G09B 19/0038
2018/0021649 A1 * 1/2018 Gong ..... A63B 71/0045 473/419
2018/0353791 A1 * 12/2018 Hugou ..... A63B 23/0205

* cited by examiner

0 - 60 degrees vertical tilt
and
360 degrees rotation

MECHANICAL APPARATUS FOR HUMAN BALANCE TRAINING

TECHNICAL FIELD

This application relates generally to an apparatus for balance training, and more specifically to an apparatus that can assist people in developing better balance as part of a training regimen.

BACKGROUND

Falls are among the most common and devastating injuries that occur in older adults. More than 25% of adults aged 65 years or older fall each year (see CDC Newsroom, 2016). The Centers for Disease Control and Prevention cite falling as the primary cause of fatal and non-fatal injuries among older adults. Falls in older adults are the cause of more than 90% of hip fractures, which substantially alter an older individual's life trajectory by leading to decreased mobility and frequently loss of autonomy.

Although falls are common in older adults, they are not an inevitable occurrence with aging. Studies suggest that evidence-based fall prevention strategies can reduce fall risk by about a third. The major contributor to fall risk is balance impairment, and substantial evidence also shows that balance can be improved with exercise. Although individuals (including older adults) frequently engage in strength and endurance training as part of a general fitness program, individuals rarely incorporate dedicated balance training as part of their regimen. This is evidenced by the paucity of balance training equipment and devices available on the marketplace. To date, the only major balance training equipment involves having users maintain stance on a mobile platform. A significant limitation of a mobile platform is that it does not address balance during walking or turning, which are among the most frequent situations where falls occur. Canes assist with stabilizing an individual's balance during walking. However, canes are an assistive device and are not intended to function as a balance training device.

SUMMARY

Disclosed embodiments are designed to improve (i.e., reduce) balance impairment and falls that occur during stance (including during turning) and with motion. Based on expertise in the mechanisms of postural control and effective balance rehabilitation, the inventors have designed a versatile device that permits users to perform many of the exercises prescribed as part of a balance therapy regimen at home. Disclosed embodiments incorporate the elements of personalization and progressive challenge, including its unique articulating, locking joint between the cross bar (sometimes referred to as a handlebar), and vertical stem (leg), which allows users to set the level of challenge appropriate for them. The inventors have also developed a suite of progressive exercises for users to perform with the disclosed embodiments, adapted from practice, which serve to progressively challenge and strengthen the proprioceptive, vestibular, and musculoskeletal systems. Disclosed embodiments can be used to train balance during walking, and there is an additional set of exercises for using the device during ambulatory balance training.

The disclosed apparatus has several novel design features. The device includes a moving handle (also referred to as a cross bar), which can be incrementally adjusted to move in tilt at varying amounts depending on the user's desired level of difficulty. The handle also rotates 360 degrees, which combined with tilt requires users to engage core muscles for strengthening that also contribute to postural stability. The handle is attached to a stem (also referred to as a leg), which reaches the ground. The stem is adjustable for user height, enabling the apparatus to be used while walking or turning.

In accordance with some embodiments, a mechanical apparatus for human balance training includes a cross bar, whose center is attached to a pivotable protrusion extending from a vertically oriented leg having a base at an end opposite the pivotable protrusion. The mechanical apparatus also includes a slidable sheath surrounding a portion of the leg proximate to the pivotable protrusion. The slidable sheath has a plurality of allowed positions relative to the leg, and each position limits tilt of the cross bar to a respective angular range.

In accordance with some embodiments, each allowed position limits tilt of the cross bar by controlling the extent by which the pivotable protrusion extends out from the sheath.

In accordance with some embodiments, the sheath is threaded relative to the leg and the plurality of allowed positions comprises a continuous range of positions adjusted by twisting the sheath relative to the leg. The twisting of the sheath causes sliding of the sheath in a direction parallel to the axis of the leg (the sliding is in a direction normal to the twisting motion).

In accordance with some embodiments, the plurality of allowed positions comprises a finite plurality of predefined locking positions. Each locking position limits tilt of the cross bar to a respective predefined angular range. In some embodiments, each locking position corresponds to a respective opening in the sheath, and the sheath engages the respective locking position when a mechanical button on the leg presses into the respective opening. In some embodiments, each locking position corresponds to a respective opening in the leg, and the sheath engages the respective locking position when a knob on the sheath is inserted into the respective opening. In accordance with some embodiments, each opening in the leg is threaded, and the sheath engages the respective locking position by twisting the knob along an axis perpendicular to the respective opening (e.g., the knob has a threaded end that engages with the threading in the opening).

In accordance with some embodiments, the angular ranges are 0°, 90°, and a plurality of angular ranges between 0° and 90°. When the angular range is 0°, the cross bar is held fixed in a position perpendicular to the leg. When the angular range is 90°, the cross bar can tilt anywhere within a 90° continuum. The continuum ranges from having the cross bar perpendicular to the leg all the way to having the cross bar parallel to the leg. When a degree measure is specified for an angular range, the tilt angle of the cross bar ranges from 0° to the specified degree measure. For example, when there is an angular range of 45°, the tilt angle of the cross bar can be anywhere between 0° and 45°. Typical intermediate angular ranges are 10°, 20°, 30°, and 45°.

The pivotable protrusion is attached to the cross bar, and a pivoting joint on the protrusion provides for the pivoting of the cross bar. If the sheath were not present, the pivotable protrusion would enable the cross bar to tilt between 0° and 90°. The positioning of the sheath provides a mechanical limit on how much tilting is possible. In some embodiments, the pivoting joint is an elbow joint of T-joint. In some embodiments, the pivoting joint is a ball joint, enabling both the pivoting and rotation of the cross bar.

Embodiments typically enable 360 degree rotation of the cross bar. In some embodiments, the pivotable protrusion is rigidly affixed to the cross bar, and the cross bar rotates by rotating the pivotable protrusion with respect to the leg. The rotatable connection is typically inside the sheath, just below the pivot joint. In this way, the cross bar rotates about an axis defined by the leg. In other embodiments, the cross bar is affixed to the pivotable protrusion using a connecting mechanism that allows rotation of the cross bar relative to the pivotable protrusion. In these embodiments, the cross bar is able to spin in a plane perpendicular to the pivotable protrusion, like a propeller. Some embodiments include a tension screw or other mechanism that controls how freely the cross bar can be rotated.

In accordance with some embodiments, the cross bar includes a pair of telescoping handles at opposing ends of the cross bar.

In accordance with some embodiments, the leg has an adjustable length. In some embodiments, the leg has a first portion that telescopes relative to a second portion of the leg. In some embodiments, the length of the leg is adjusted according to a plurality of leg locking positions. In some embodiments, the first portion has a plurality of openings, each opening corresponding to a respective leg locking position. In some embodiments, a respective leg locking position is engaged when a mechanical button on the second portion of the leg presses into the respective opening in the first portion.

In accordance with some embodiments, a latch is attached to the leg. The cross bar can be detachably coupled to the latch when the sheath is in a position that provides an angular range of 90°. This enables the apparatus to fold into a more compact shape for storage.

In order to use the apparatus, the base touches a floor surface, the ground, or other surface on which a user is standing or walking. There needs to be adequate support/friction so that the base of the apparatus does not slip while in use. In some embodiments, the base is a cap comprising a material having a high coefficient of static friction. In this aspect, the cap may be made of rubber or similar material, as used in conventional canes. In some embodiments, having a high coefficient of static friction means a coefficient that is greater than 0.6. In accordance with some embodiments, the base comprises a disc perpendicular to the leg or the base comprises two or more elongated members in a plane perpendicular to the leg.

Therefore, disclosed embodiments can be used by people for balance training, which can reduce the overall risk of falls.

BRIEF DESCRIPTION OF THE DRAWINGS

For a better understanding of the various described embodiments, reference should be made to the Description of Embodiments below, in conjunction with the following drawings in which like reference numerals refer to corresponding parts throughout the figures.

DESCRIPTION OF EMBODIMENTS

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details.

FIGS. 1A-1L illustrate a first apparatus 100 for human balance training in accordance with some embodiments. The apparatus 100 includes a cross bar 102, which typically has handles at both ends. In some embodiments, the cross bar consists of a single piece, but in other embodiments, the cross bar comprises two or more pieces, as illustrated below. In some instances, the cross bar is referred to as a handle. This is the portion of the apparatus that is held by one or both of a user's hands.

Figure 1A:
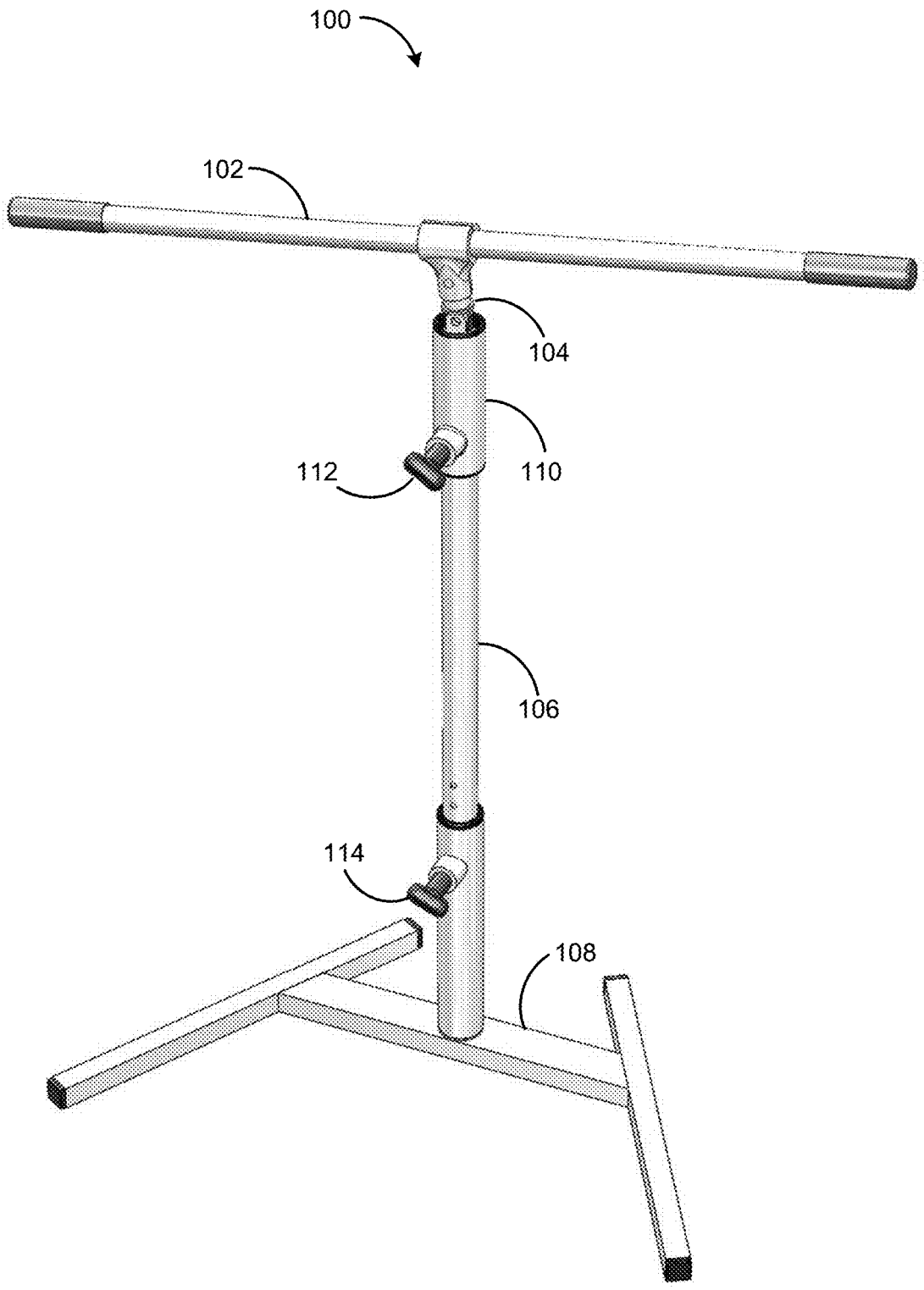
FIGS. 1A-1L illustrate a first apparatus for human balance training in accordance with some embodiments.

As illustrated in FIG. 1A, the cross bar 102 is attached to a pivotable protrusion 104, which extends out of a sheath 110, at the top of the leg 106. As explained in more detail below, the sheath 110 is slidable along the leg, and the position of the slidable sheath on the leg 106 controls the amount of tilt that is possible for the cross bar 102. In some embodiments, the slidable sheath moves by sliding the sheath vertically relative to the leg. In other embodiments, the sheath moves vertically based on a twisting motion of the sheath relative to the leg 106. In the embodiment shown in FIG. 1A, the sheath 110 is held in position by a knob 112, which protrudes through the sheath. In some embodiments, there is a set of openings in the leg 106, and the knob holds the sheath in position based on insertion into one of the openings in the leg. In some embodiments, the knob is threaded, and the threading of the knob engages with corresponding threading in the leg openings or a nut 120 (see FIG. 2A) that is located between the sheath 110 and the leg 106.

At the bottom of the apparatus 100 is a base 108. As illustrated in other embodiments, the base may be constructed using a variety of shapes and materials. In the embodiment of FIG. 1A, the base has a plurality of elongated members to form a base that can hold the apparatus upright without other support.

The apparatus 100 typically includes an adjustment mechanism to accommodate a variety of user heights. In the embodiment of FIG. 1A, the leg 106 is telescoping, with a smaller cylindrical shape inside a larger cylindrical shape at the bottom. In this embodiment, the height of the apparatus is fixed by a second knob 114, which engages openings in the leg, similar to the knob 112 used to hold the sheath 110 in place.

Figure 1B:
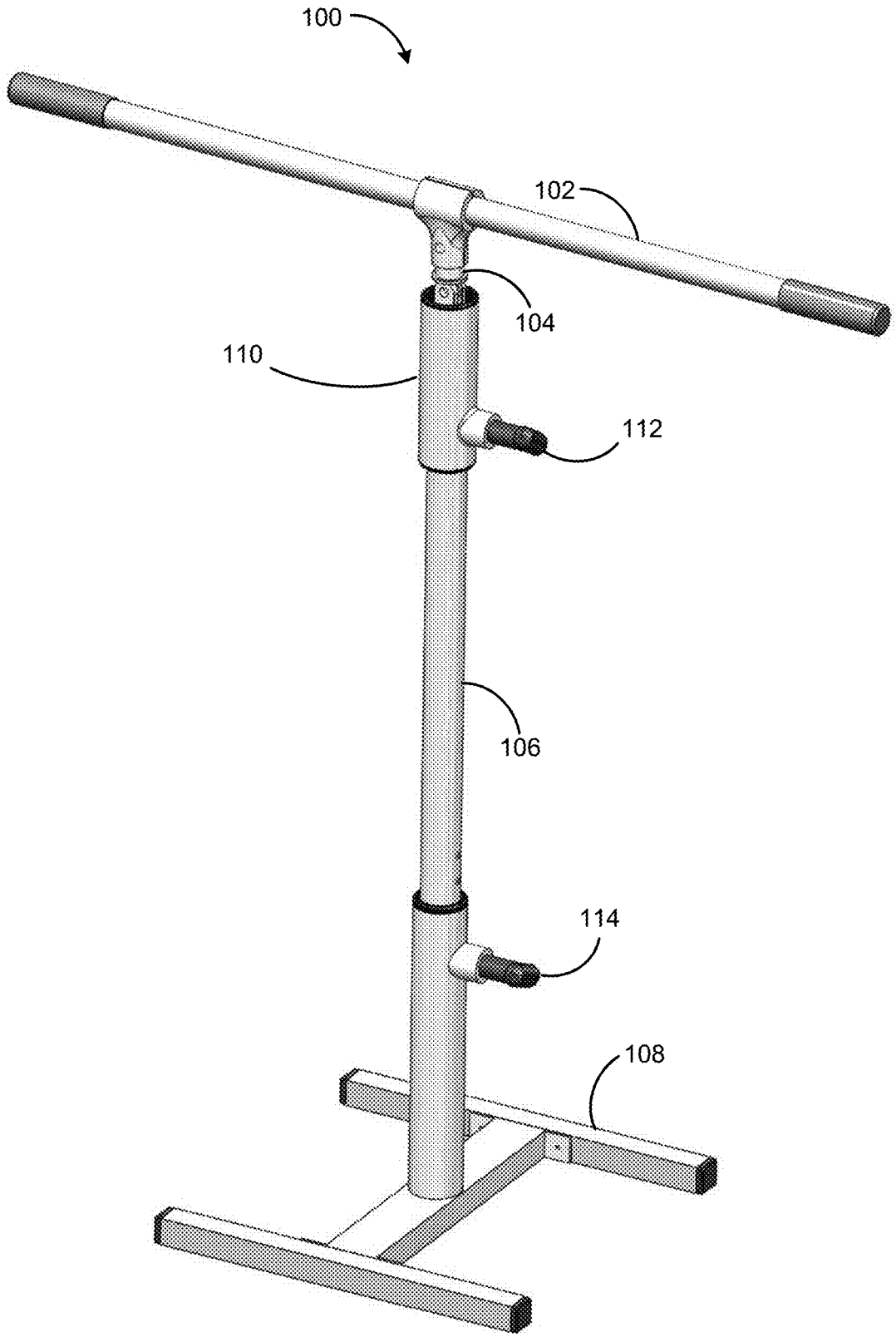

FIG. 1B is a side view of the apparatus, showing the knobs 112 and 114 from the side. FIG. 1B also indicates that the cross bar 102 is able to tilt based on the extension of the pivotable protrusion out of the sheath 110.

Figure 1D:
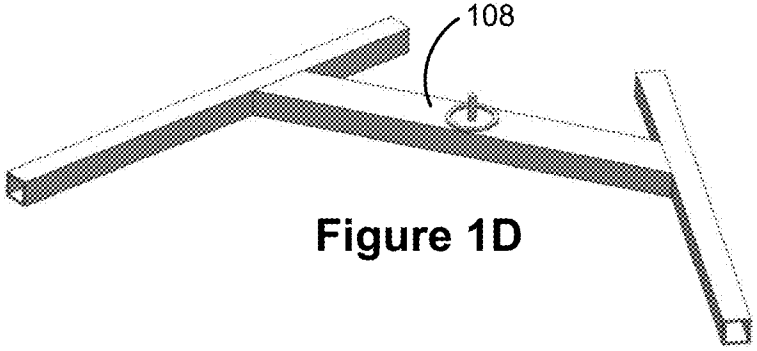
Figure 1C:
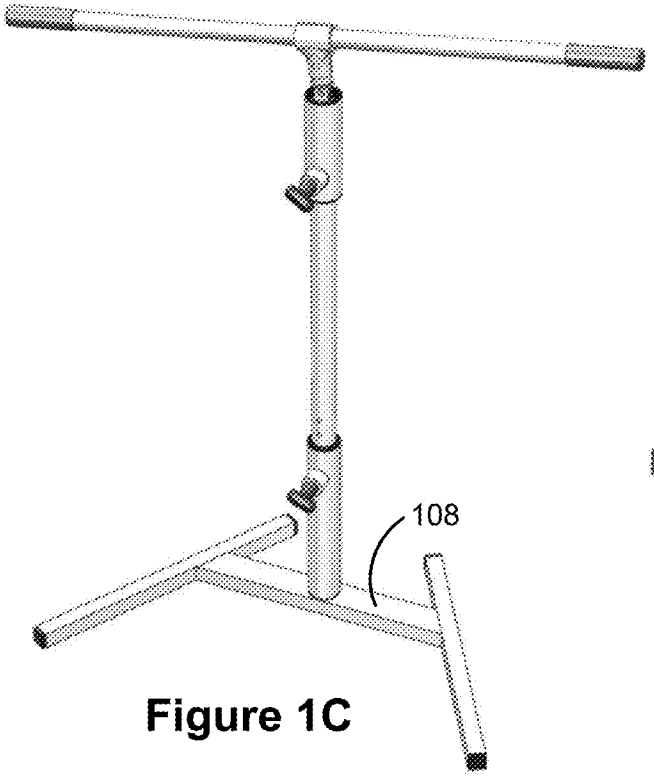

FIGS. 1C and 1D illustrate how some embodiments attach the leg 106 to the base 108. In some embodiments, the base 108 is made of aluminum or other metals, and the ends of some of the elongated members are capped by plastic or rubber stoppers.

Figure 1E:
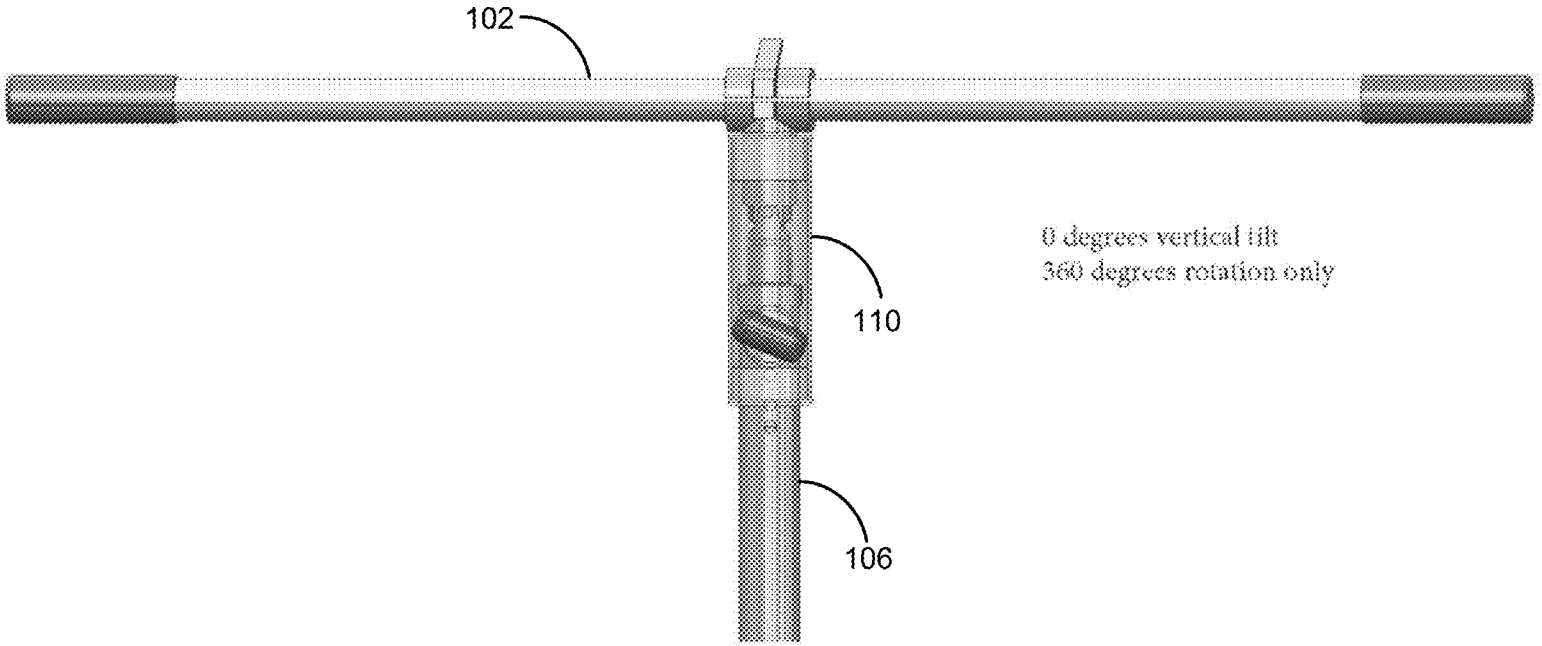

FIG. 1E shows the top portion of the apparatus 100 according to some embodiments. In this illustration, the sheath 110 is shown as transparent in order to see the leg 106 and pivotable protrusion 104 hidden inside the sheath 110. In this maximal position of the sheath 110, the sheath 110 abuts the cross bar 102 (or a bracket connecting the cross bar 102 to the pivotable protrusion 104). Because the sheath 110 abuts the cross bar 102, the cross bar 102 is not able to tilt. This is referred to as having an angular range of 0°. Even though the cross bar 102 cannot tilt, it is still able to rotate 360° around an axis along the leg 106.

Figure 1F:
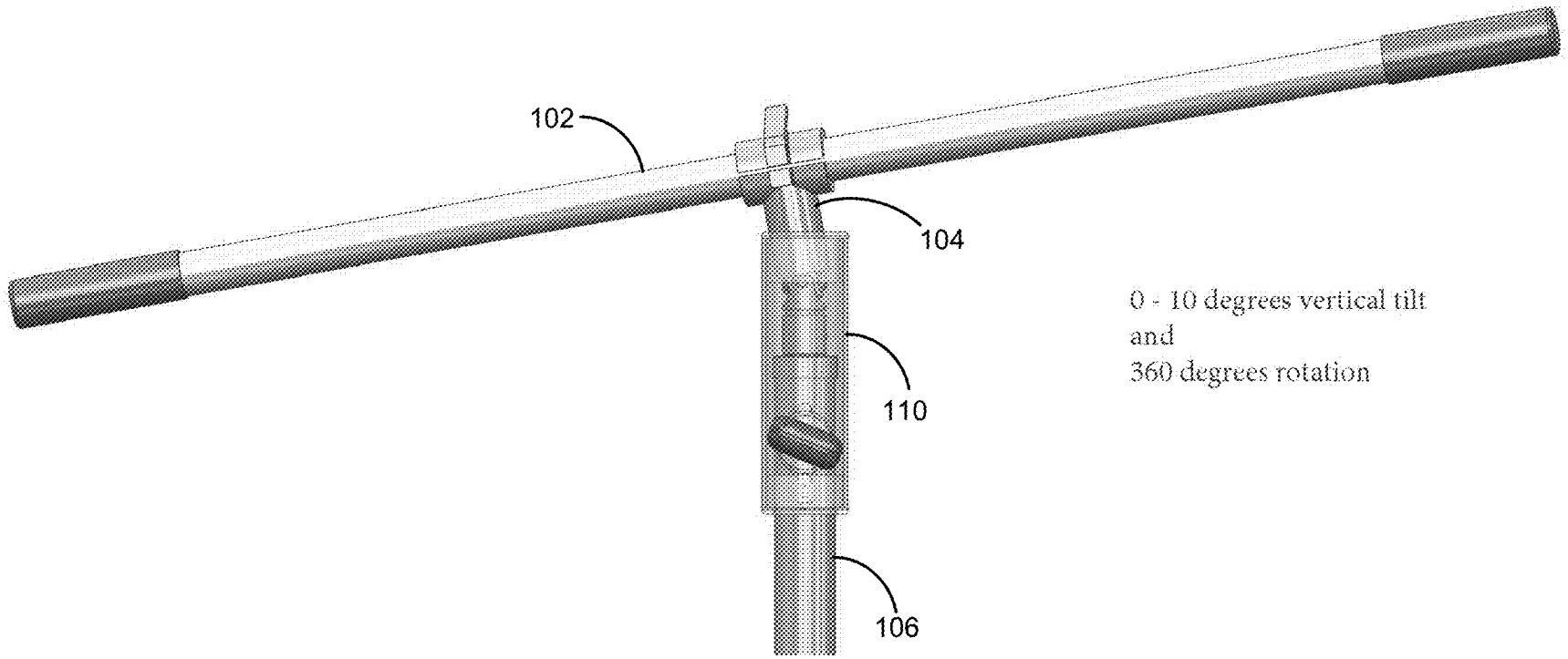
Figure 1G:
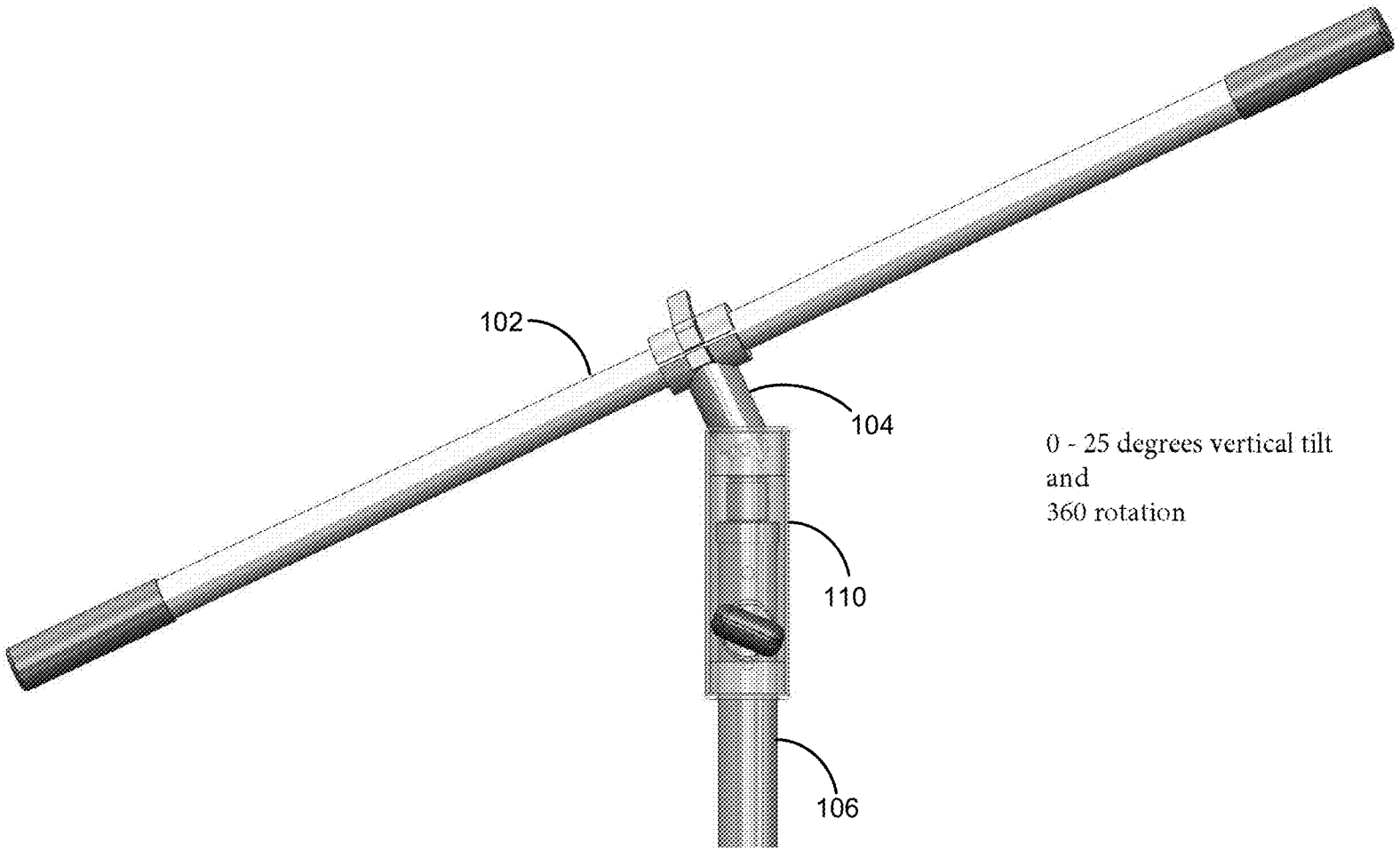
Figure 1H:
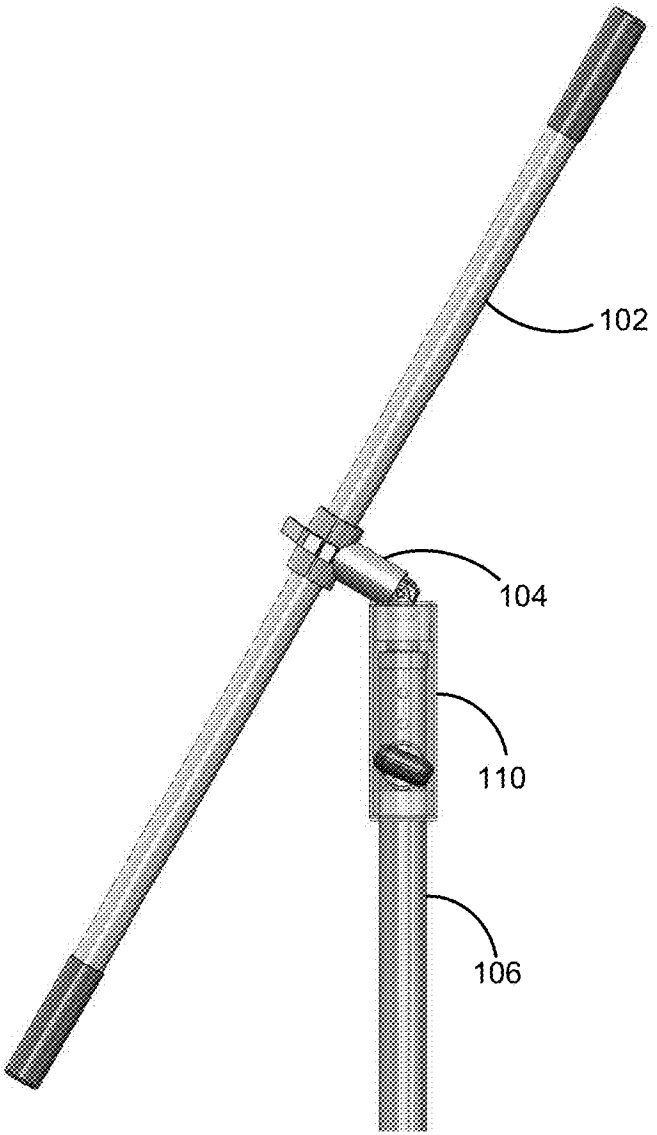

FIGS. 1F, 1G, and 1H show the sheath 110 at successively lower positions along the leg 106, each position providing a greater angular range for tilting. In FIG. 1F the angular range is 10°, in FIG. 1G the angular range is 25°, and in FIG. 1H the angular range is 60°. Because the sheath is shown as transparent, the figures also show that in each of these figures the knob 112 engages with a successively lower opening in the leg 106.

Figure 1I:
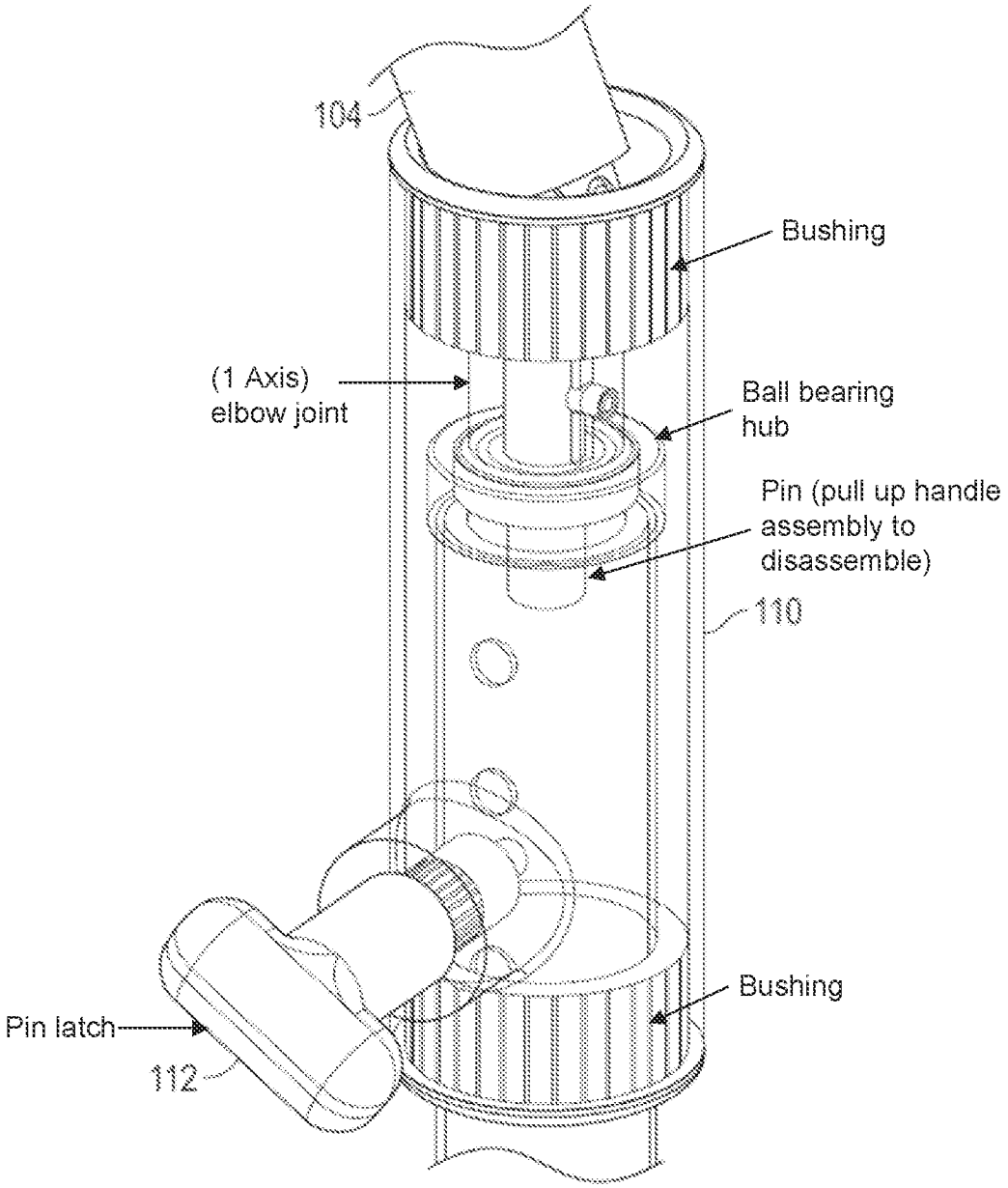

FIG. 1I is a magnified view of the sheath 110 and the portions of the apparatus in proximity to the sheath 110. This magnified view shows the sheath as transparent in order to make the interior components visible. In this embodiment, bushings at the top and bottom of the sheath orient the sheath 110 with respect to the leg 106. The ball bearing hub attached to the pivotable protrusion (elbow joint) 104 allows the pivotable protrusion 104 (and thus the cross bar 102) to rotate with respect to the leg. Also visible on the leg 106 inside the sheath are openings, which can be engage with the knob (pin latch) 112.

Figure 1J:
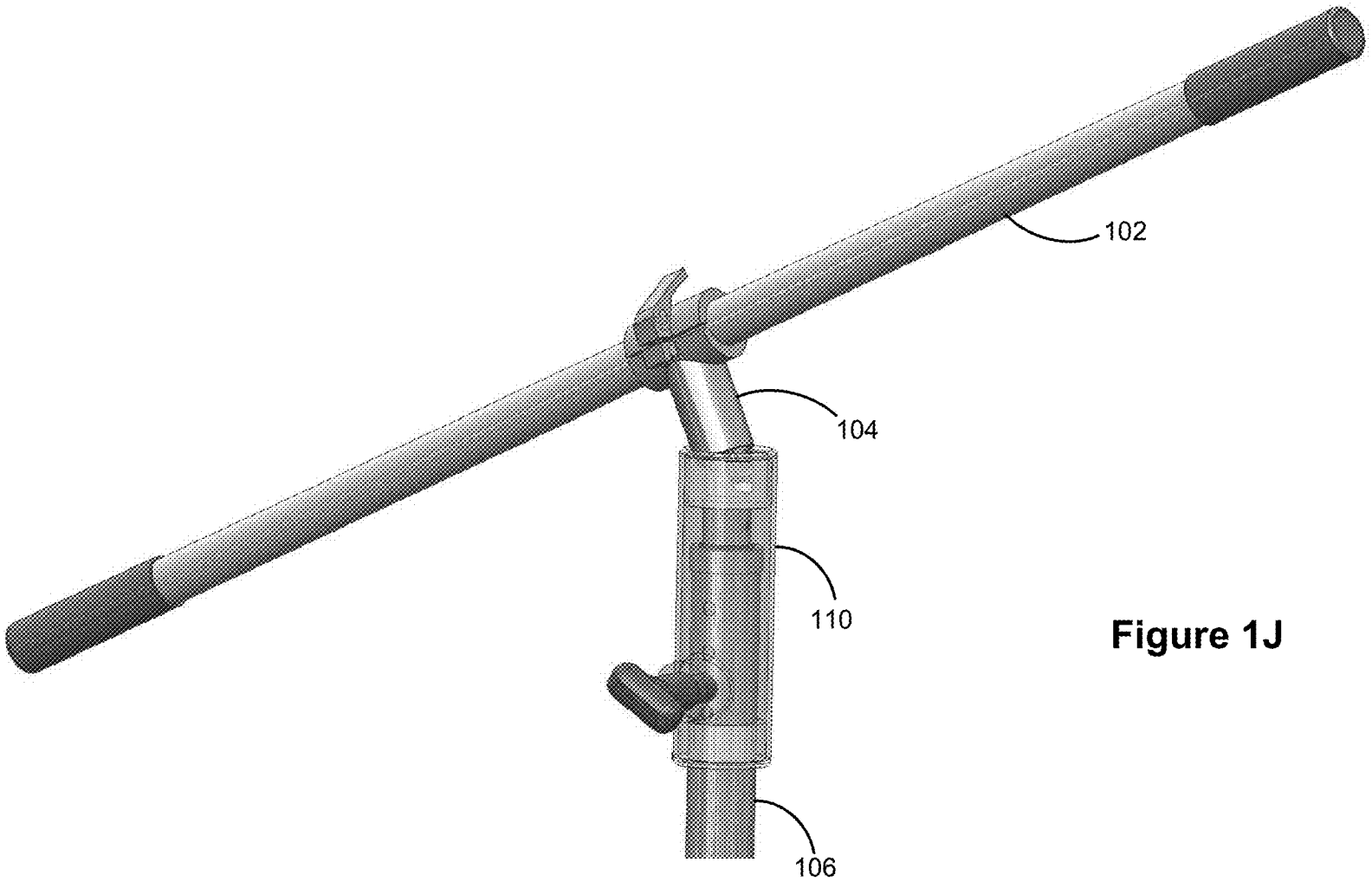

FIG. 1J is a slightly larger view of the apparatus portion shown in FIG. 1I.

Figure 1K:
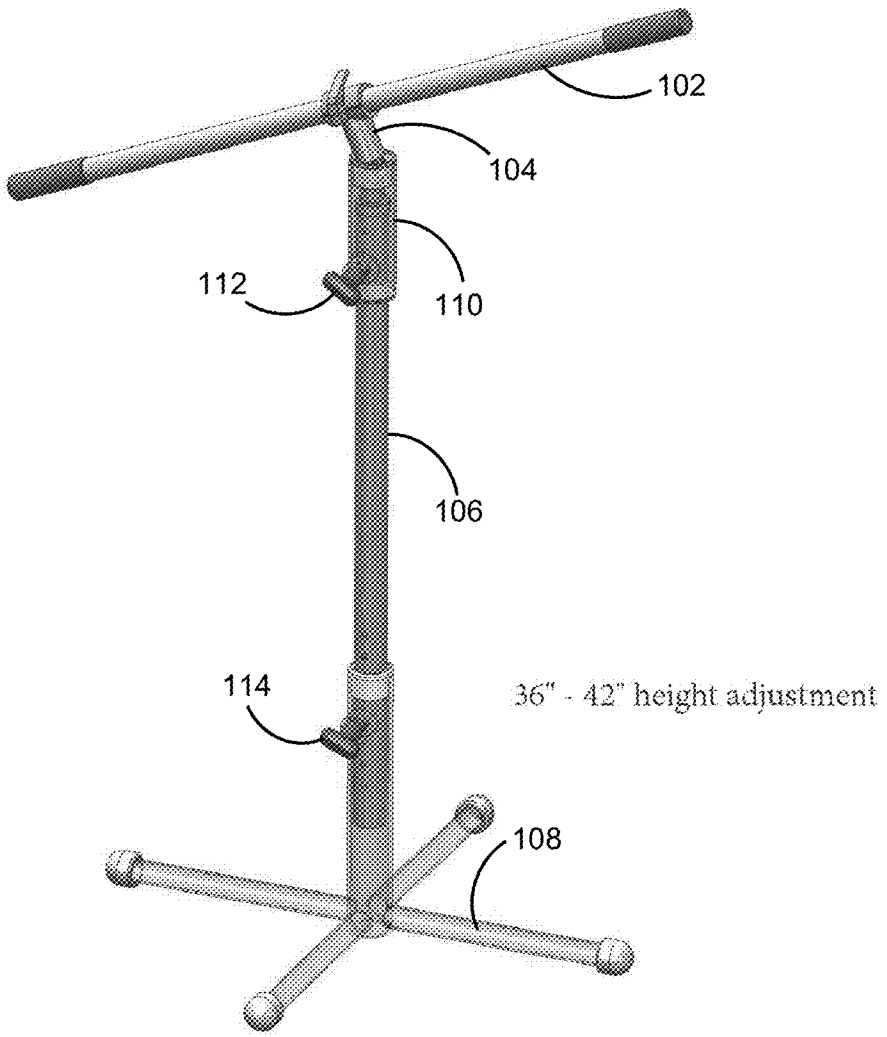
Figure 1L:
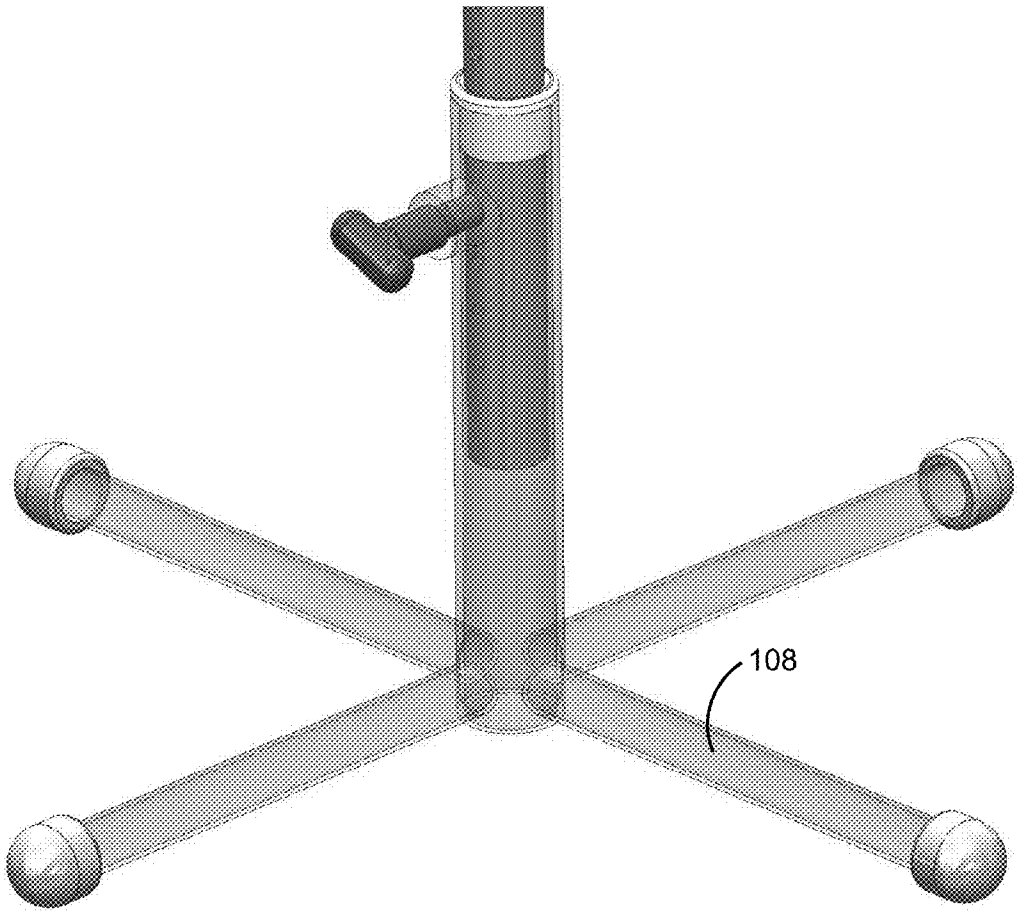

FIGS. 1K and 1L illustrate an alternative base 108, which is used in some embodiments.

FIGS. 2A-2D illustrate a second apparatus for human balance training in accordance with some embodiments.

Figure 2A:
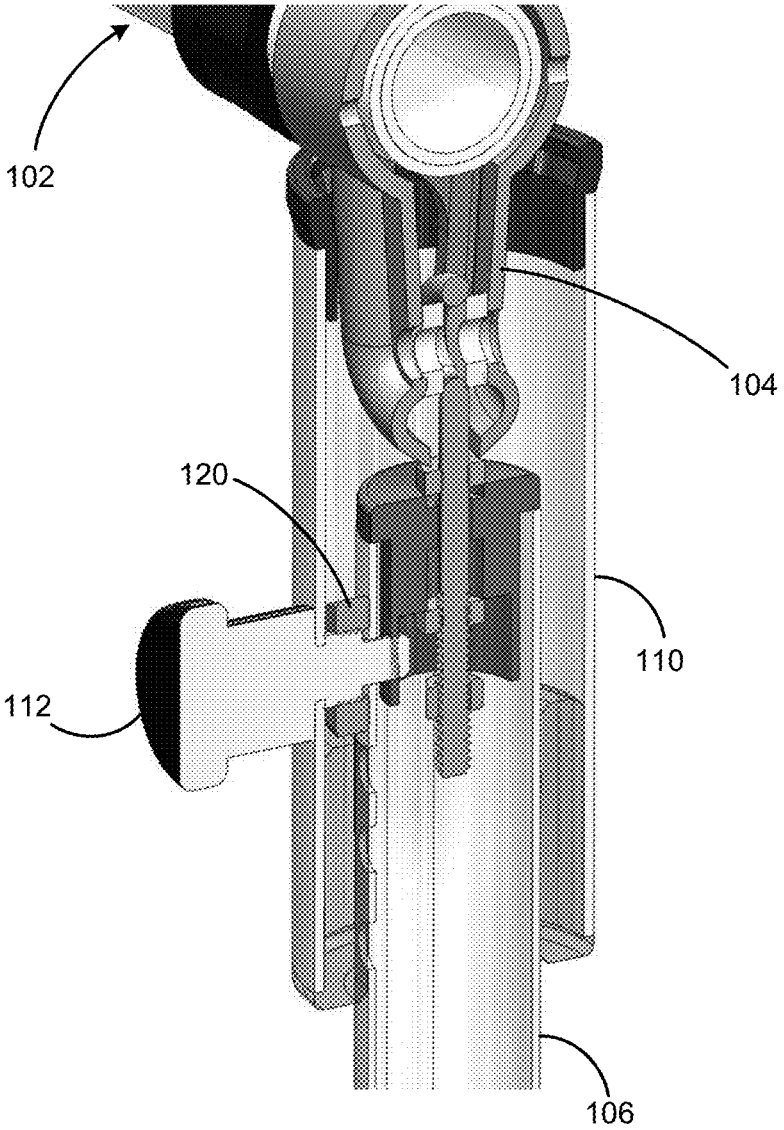
FIGS. 2A-2D illustrate a second apparatus for human balance training in accordance with some embodiments.

FIG. 2A provides a sectional view of the sheath 110 and surrounding portions of the apparatus, in accordance with some embodiments. FIG. 2A illustrates the use of a nut 120 to engage an end of the knob 112 into an opening in the leg 106.

Figure 2B:
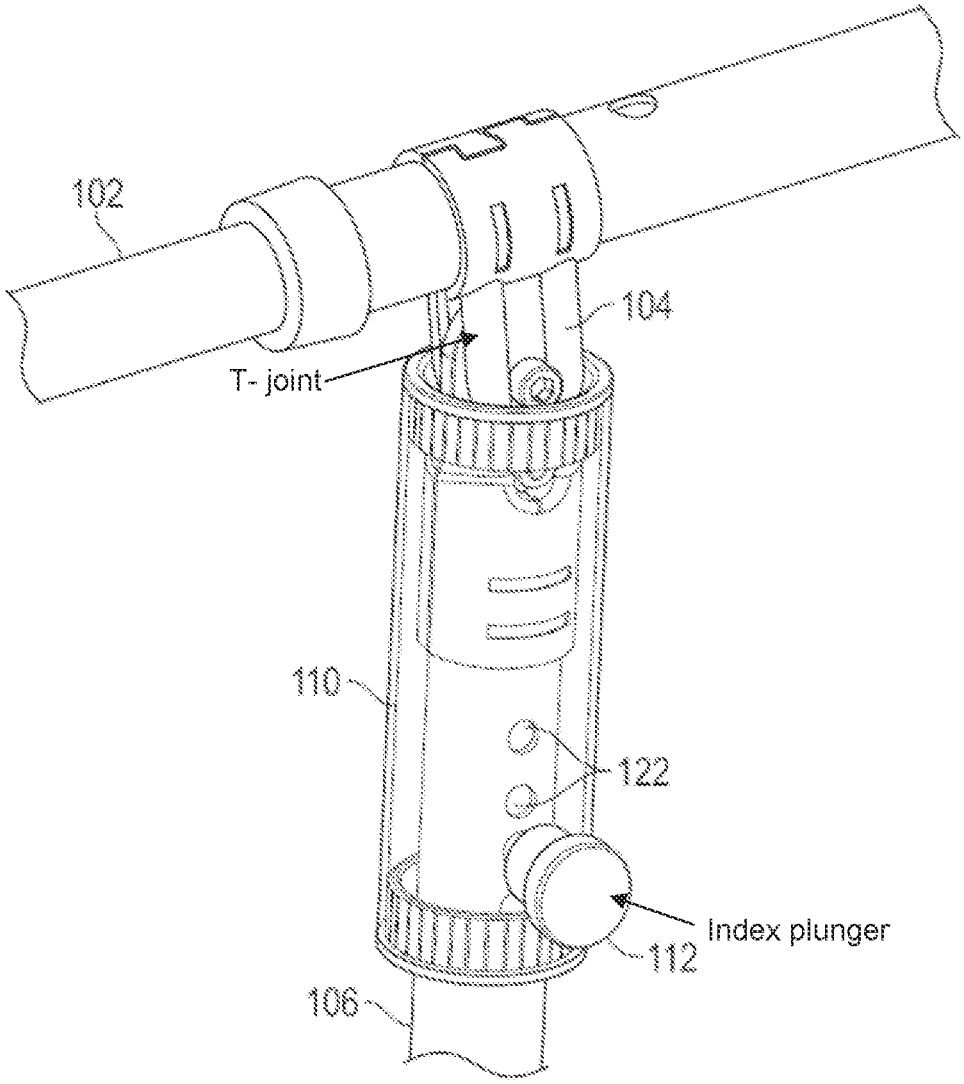

FIG. 2B is a magnified view of the sheath 110, showing the sheath as transparent. As in FIG. 1I, this figure shows the bushings that align the sheath 110 with the leg 106 and show the pivotable protrusion (sometimes referred to as a T-joint or elbow joint) sticking out from the sheath 110. FIG. 2B also shows that the knob (index plunger) 112 can engage with any of the openings 122 in the leg to adjust the vertical position of the sheath relative to the leg, and thus control the tilt angle range. In this embodiment, there are four openings 122, corresponding to the angular ranges 0°, 10° (currently engaged), 45°, and 90°.

Figure 2C:
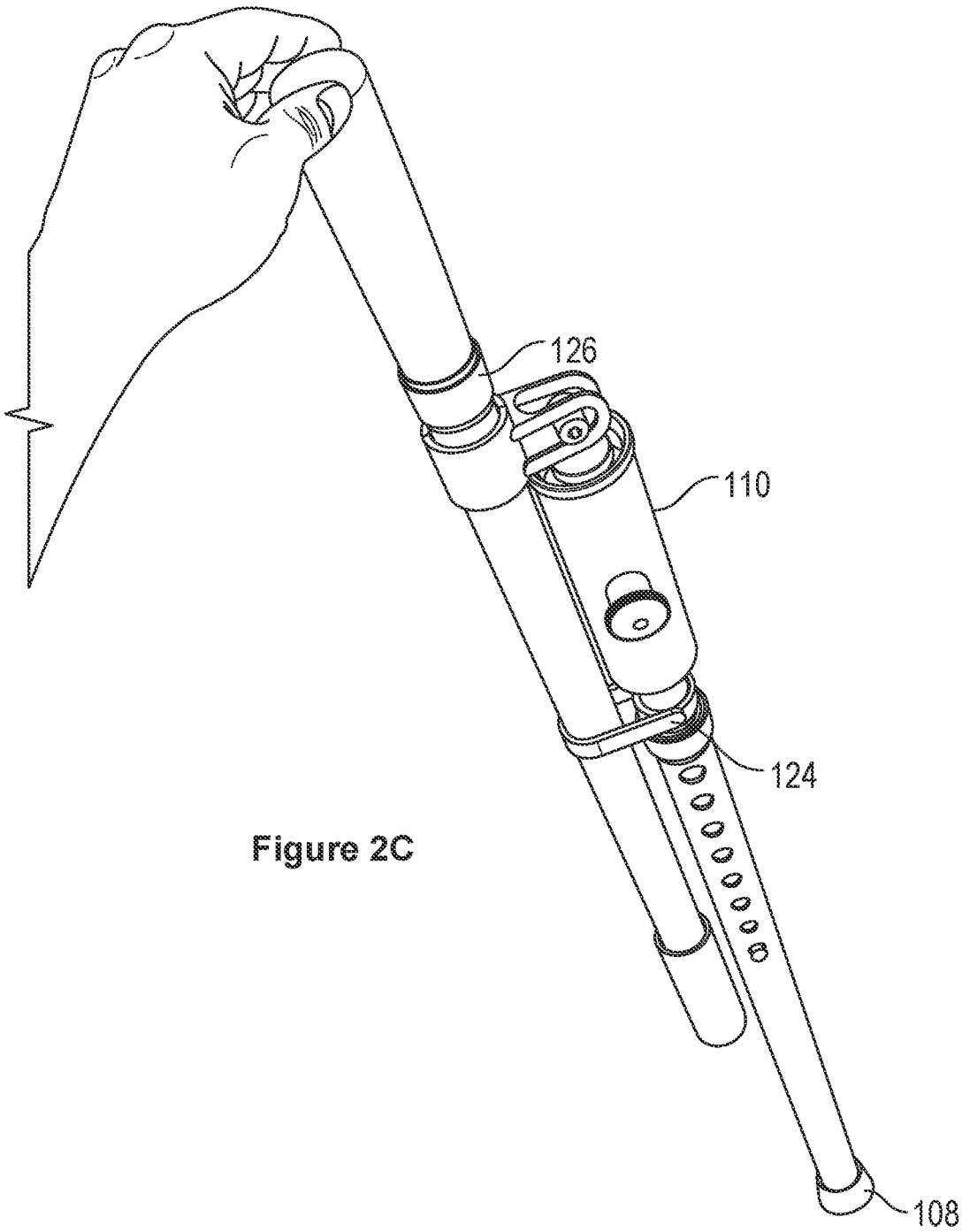
Figure 2D:
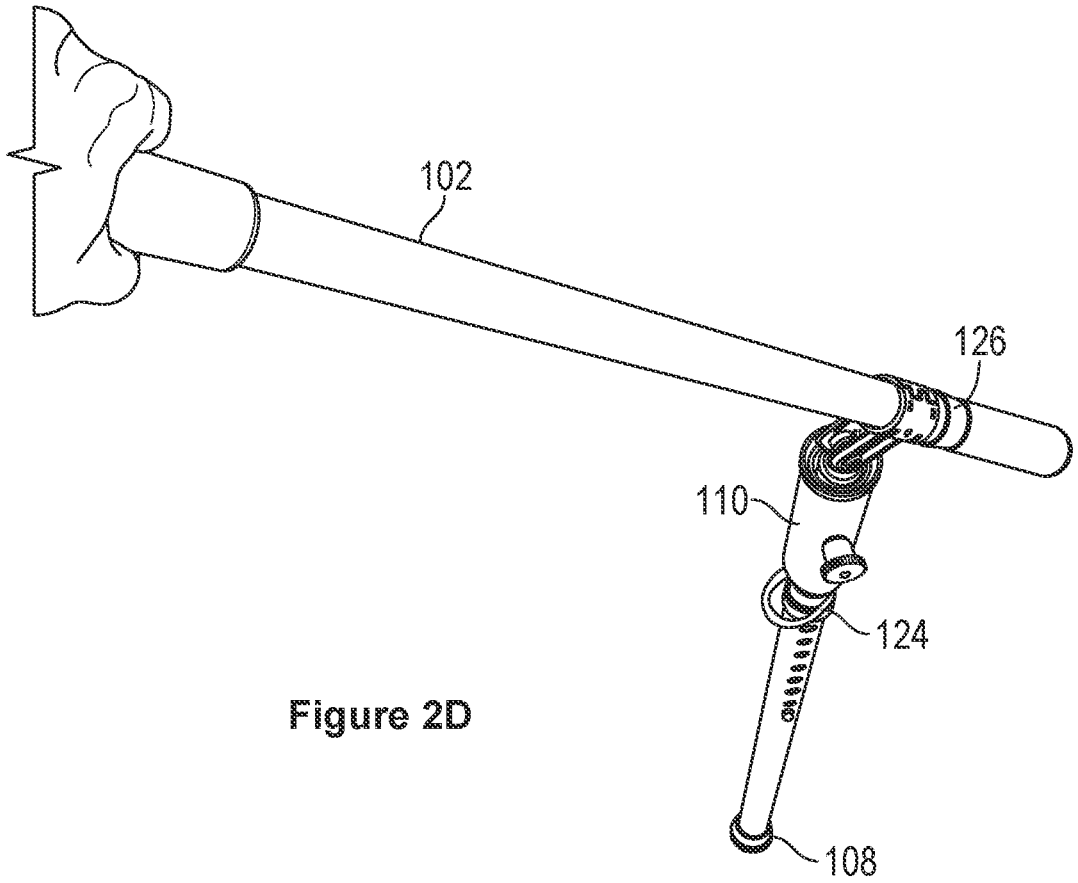

FIGS. 2C and 2D illustrate some additional features of some embodiments. The illustrated embodiment has a telescoping cross bar comprising two sections. One of the sections fits inside the other, and the two sections are held together by a clutch lock 126. The illustrated embodiment also includes a latch/strap 124, which can be used to hold the cross bar 102 together with the leg 106 when the apparatus is not in use. This embodiment also has a simple base 108 comprising a cap for the leg pole 106. In some embodiments, the base is made of rubber or other material with a high coefficient of static friction (e.g., greater than 0.6).

Figure 3A:
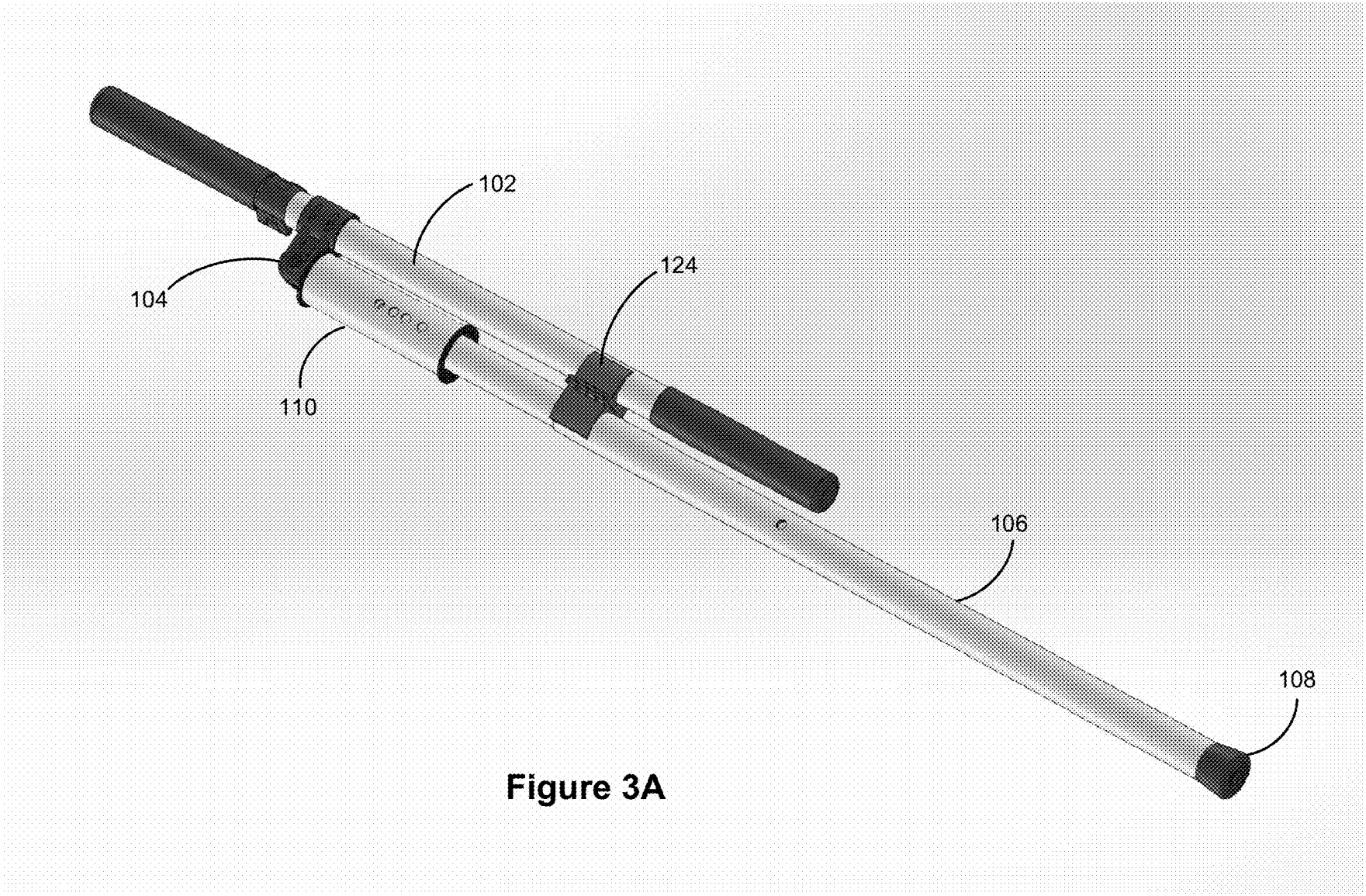
FIGS. 3A-3J illustrate a third apparatus for human balance training in accordance with some embodiments.

FIGS. 3A-3J illustrate a third apparatus for human balance training in accordance with some embodiments. FIG. 3A shows the apparatus in a closed state, with the cross bar 102 clipped to the leg 106 by a latch 124. This embodiment utilizes a spring button lock for the sheath 110, with openings in the sheath and a spring button attached to the leg 106. The sheath is held in one of the fixed positions defined by the openings when the spring button presses into one of the openings. Some embodiments also use a spring button for adjusting the length of the leg (which can be telescoping).

Figure 3B:
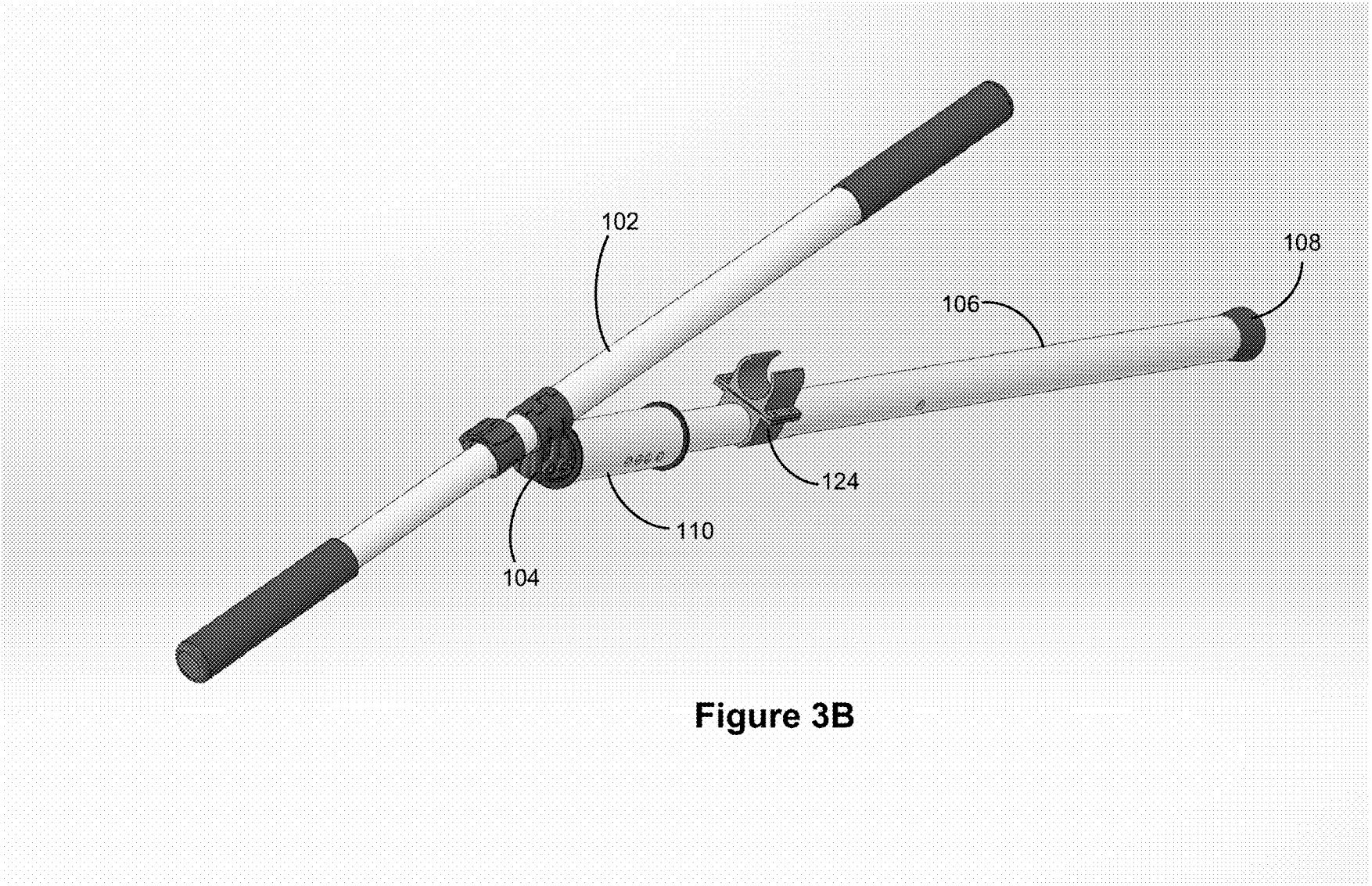
Figure 3C:
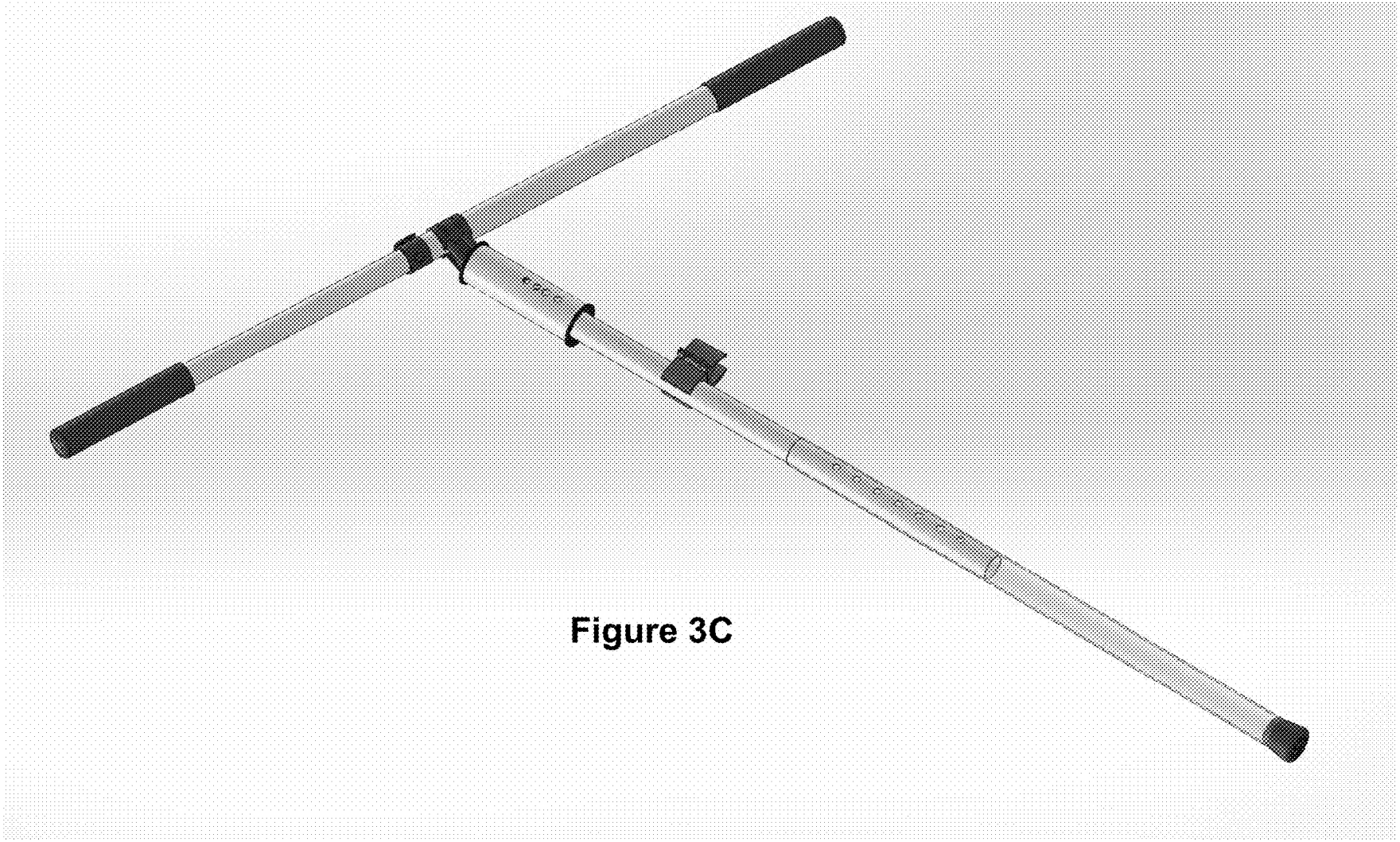

FIG. 3B shows the same apparatus as FIG. 3A, but with the cross bar 102 detached from the latch 124. FIG. 3C shows the apparatus with the cross bar 102 substantially perpendicular to the leg 106.

Figure 3D:
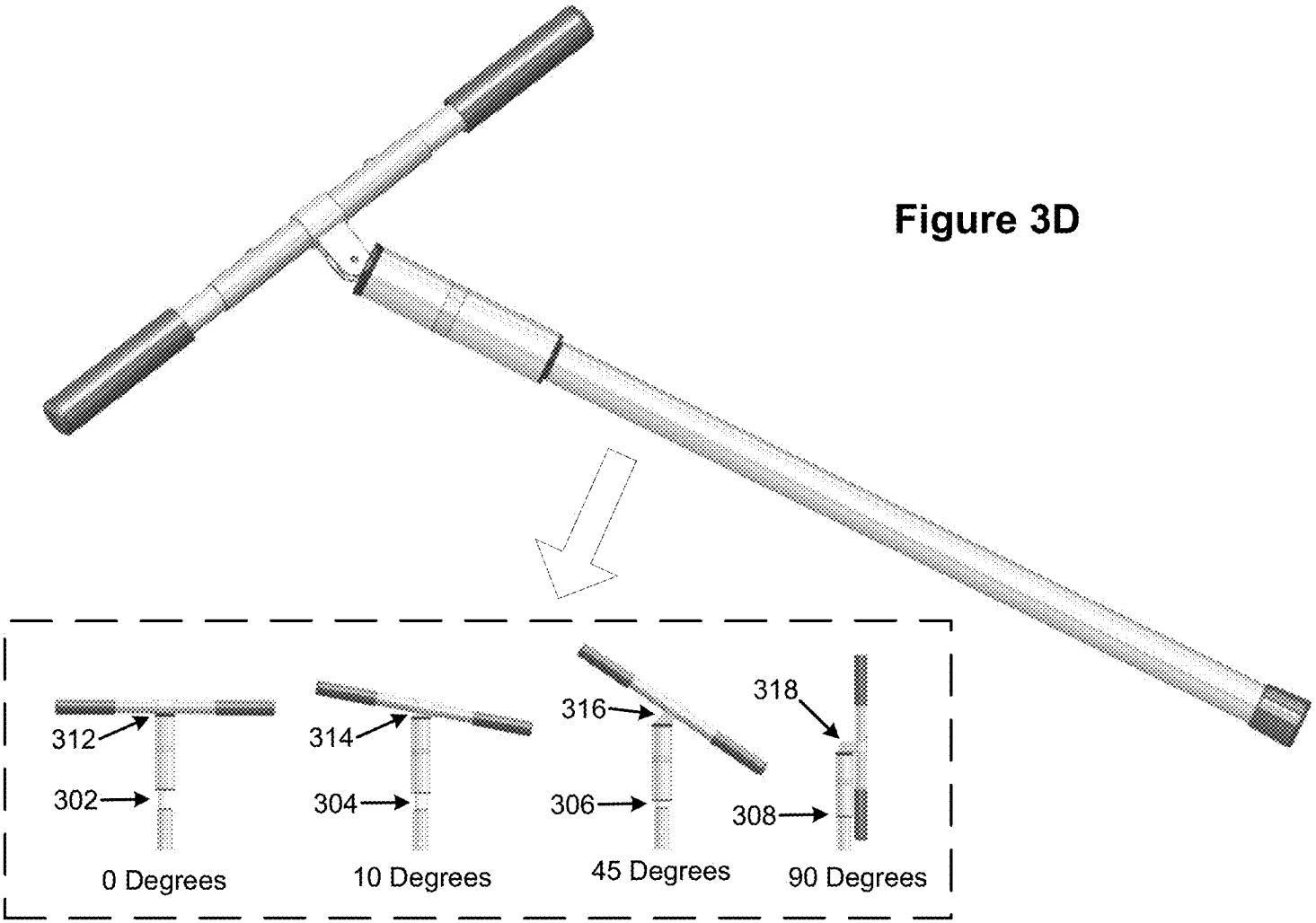

The inset in FIG. 3D illustrates how the angular range of the cross bar 102 correlates with the vertical position of the sheath 110 relative to the leg 106. In the first orientation (labeled "0 Degrees"), the sheath 110 is as far vertical as it can get, creating a large gap 302 at the base of the sheath, and no gap 312 at the top of the sheath. The absence of a gap at the top means that the cross bar 102 cannot tilt. In the second orientation (labeled "10 Drgrees"), there is a slightly smaller gap 304 at the base of the sheath, and a small gap 314 at the top of the sheath, which allows a 10 degree angular range for tilting the cross bar 102. In the third orientation (labeled "45 Degrees"), the lower gap 306 is much smaller, thereby making the upper gap 316 much larger. With this position of the sheath 110, the cross bar has an angular range of 45 degrees. Finally, in the fourth position (labeled "90 Degrees"), the lower gap 308 is zero, and the upper gap 318 is maximal. In this orientation, the cross bar 102 has a full 90 degree angular range, going anwhere from horizontal to vertical.

Figure 3E:
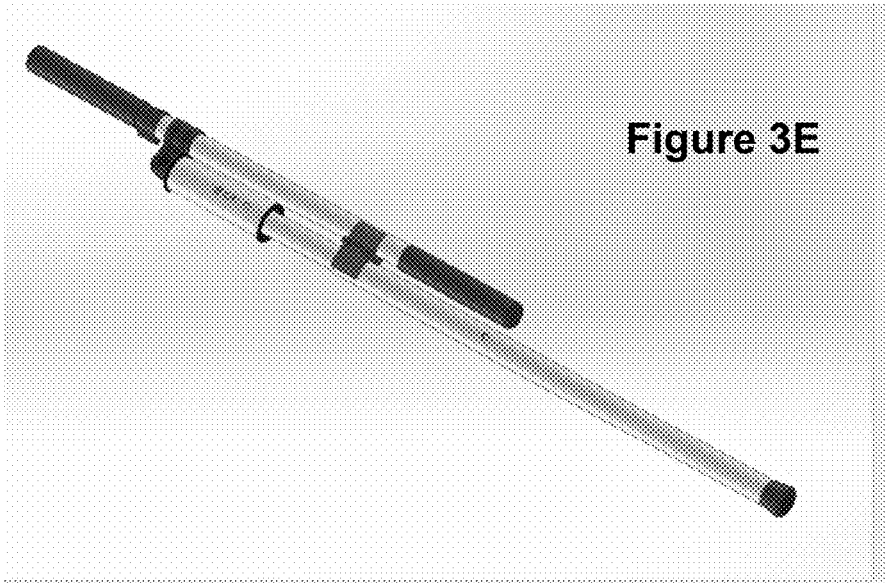
Figure 3F:
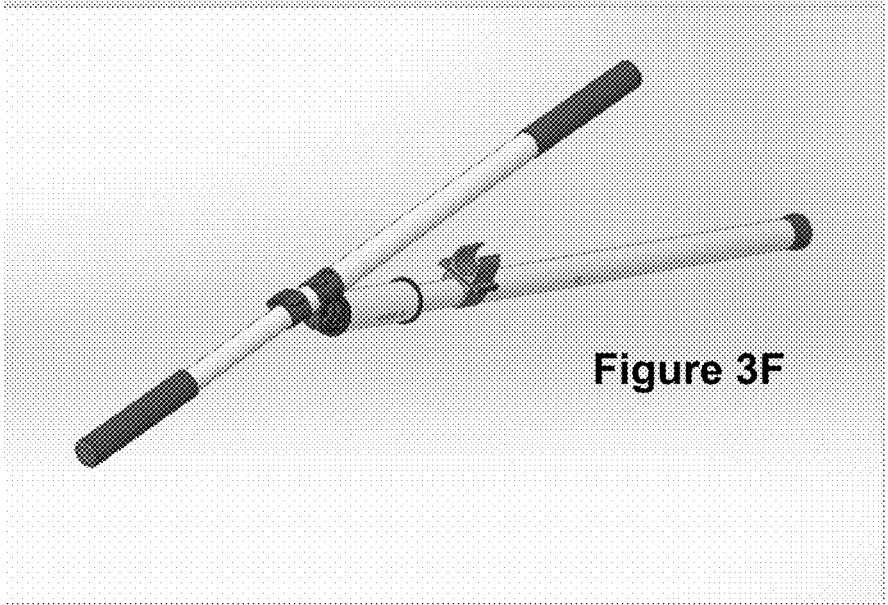
Figure 3G:
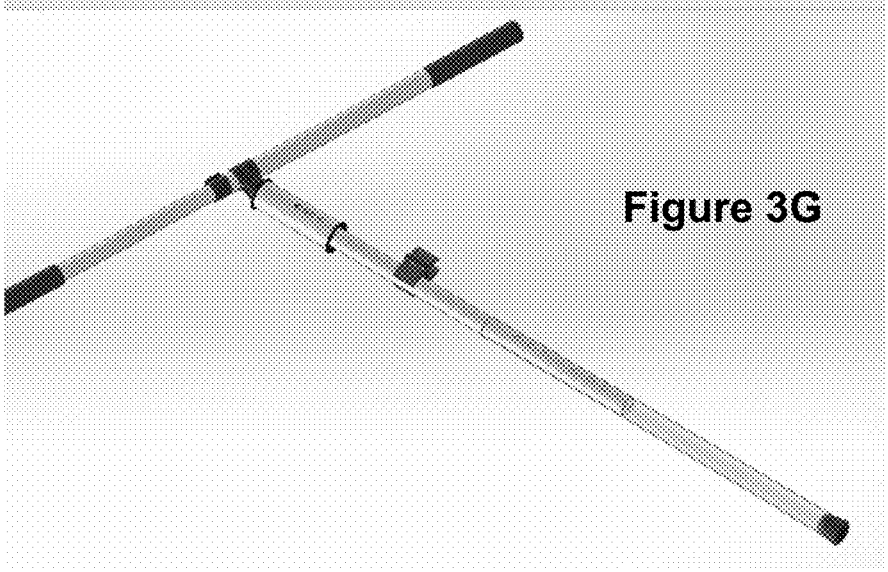

FIGS. 3E-3G illustrate different amounts of tilt for the apparatus.

Figure 3H:
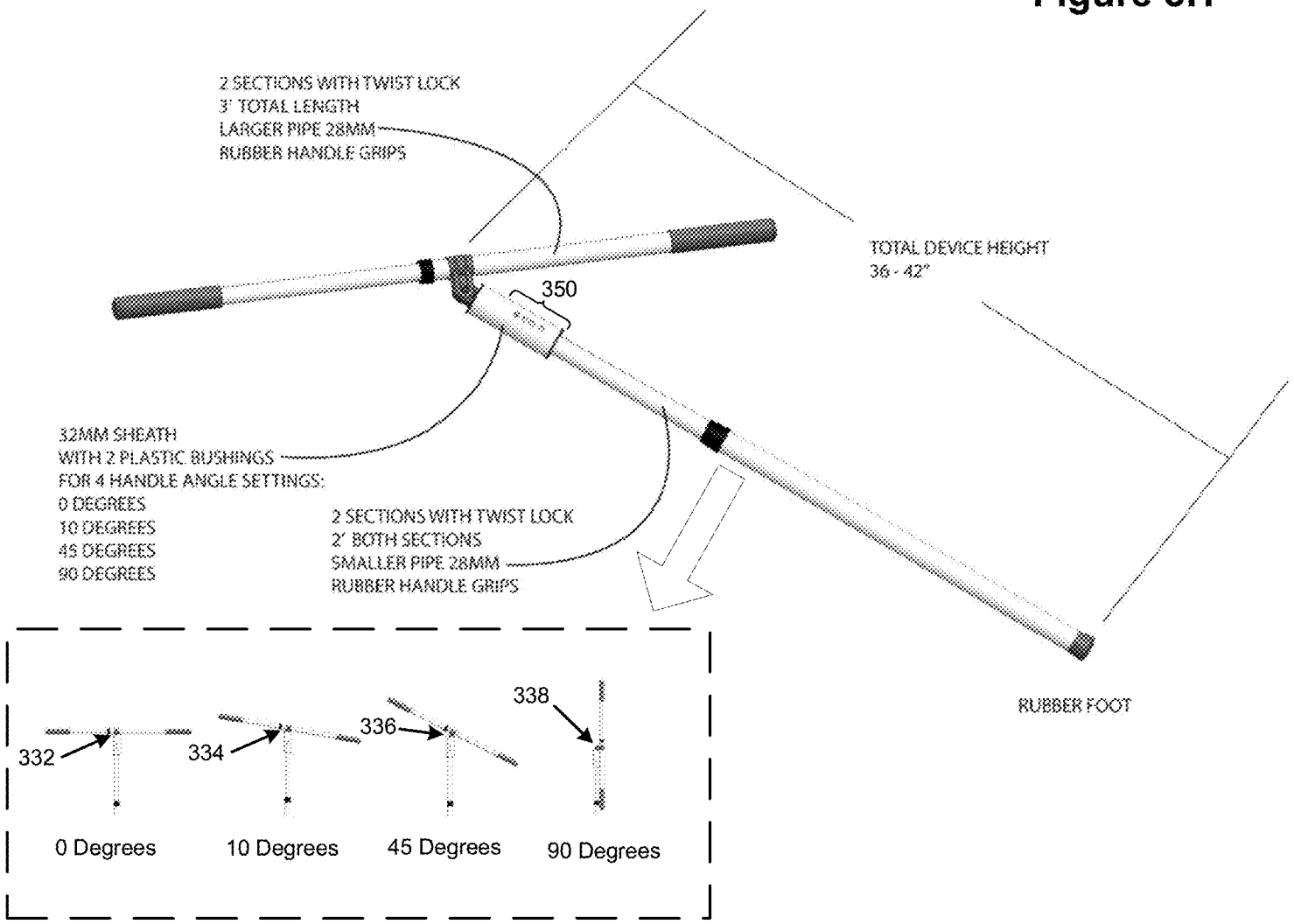

Like FIG. 3D, FIG. 3H has an inset that illustrates the angular range of allowed tilt based on the position of the sheath 110. The gaps 332, 334, 336, and 338 illustrate that as the sheath 110 is moved down, the gap allows greater tilt. FIG. 3H also illustrates a sheath 110 that is held in place by a spring button lock mechanism 350. The mechanism includes 4 distinct openings in the sheath 110, each corresponding to a different tilt angular range. In the illustration of FIG. 3H, the spring button is engaged in the topmost of the four openings.

Figure 3I:
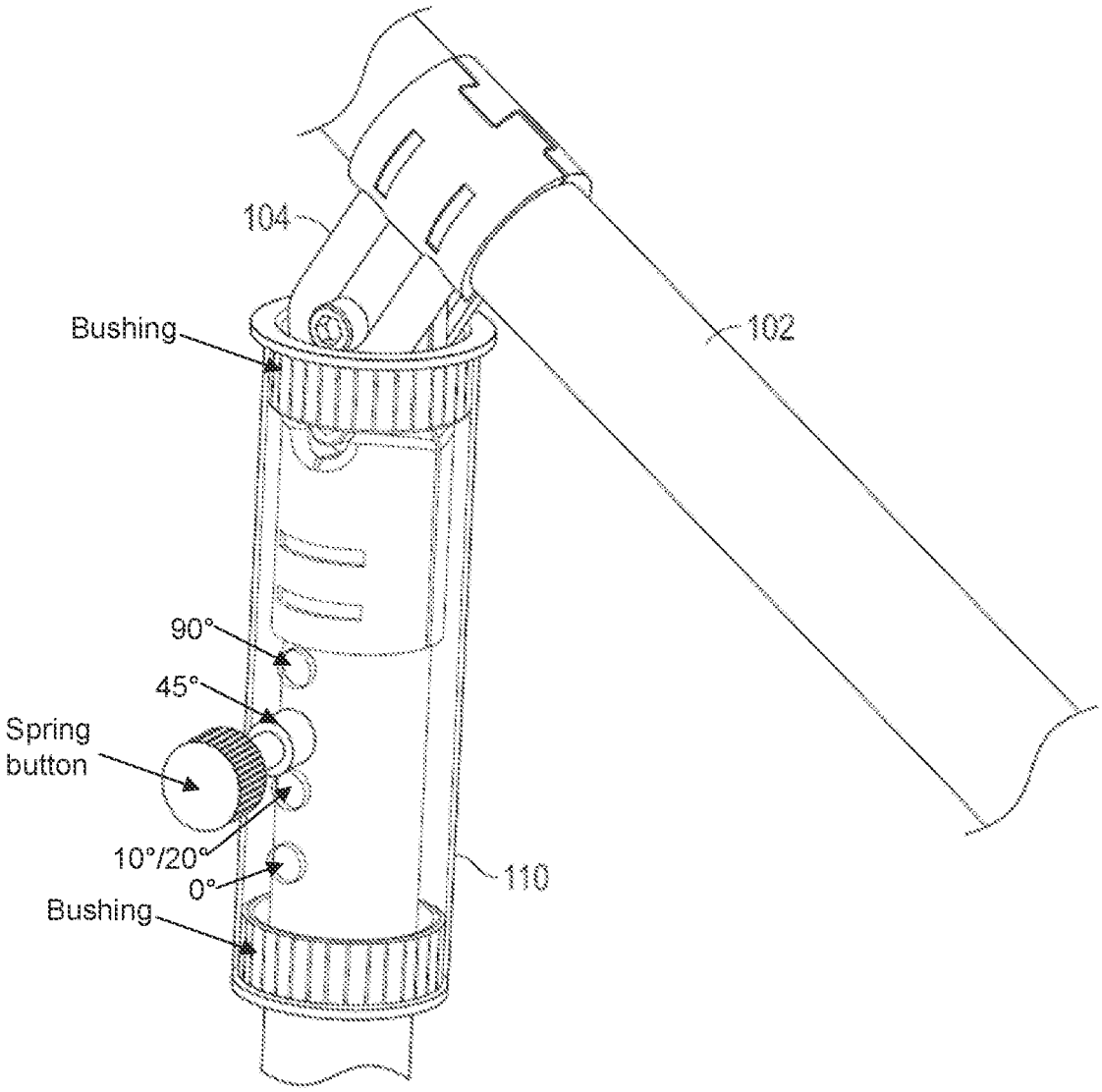
Figure 3J:
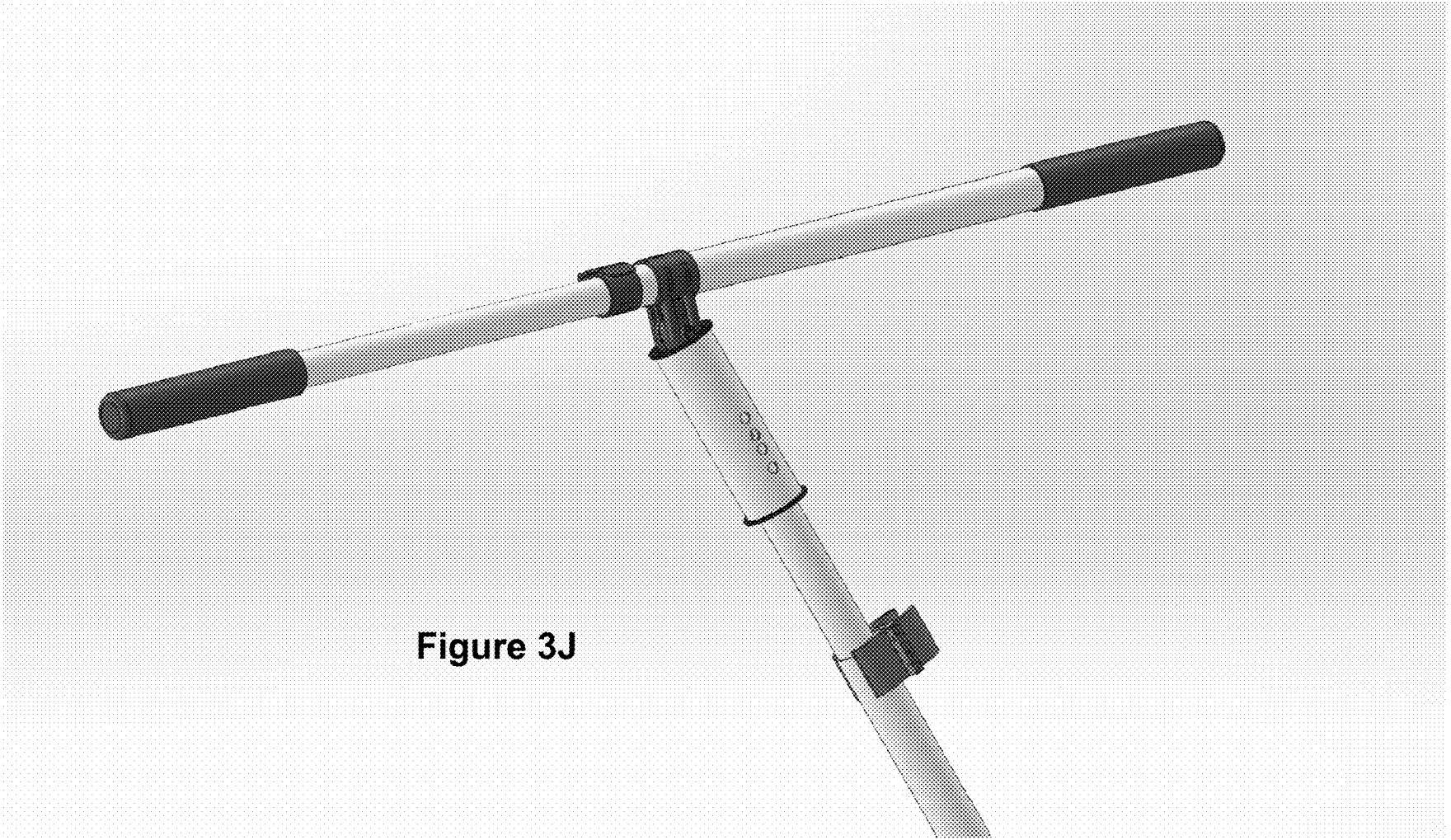

FIG. 3I shows a magnified view of the sheath area, with the sheath 110 shown as transparent. The bushings at the top and bottom are labeled. FIG. 3I also illustrates a spring button, which could be replaced by a knob, as illustrated in some of the embodiments above. FIG. 3J illustrates the upper portion of the apparatus.

FIGS. 4A-4I illustrate a fourth apparatus for human balance training in accordance with some embodiments.

Figure 4A:
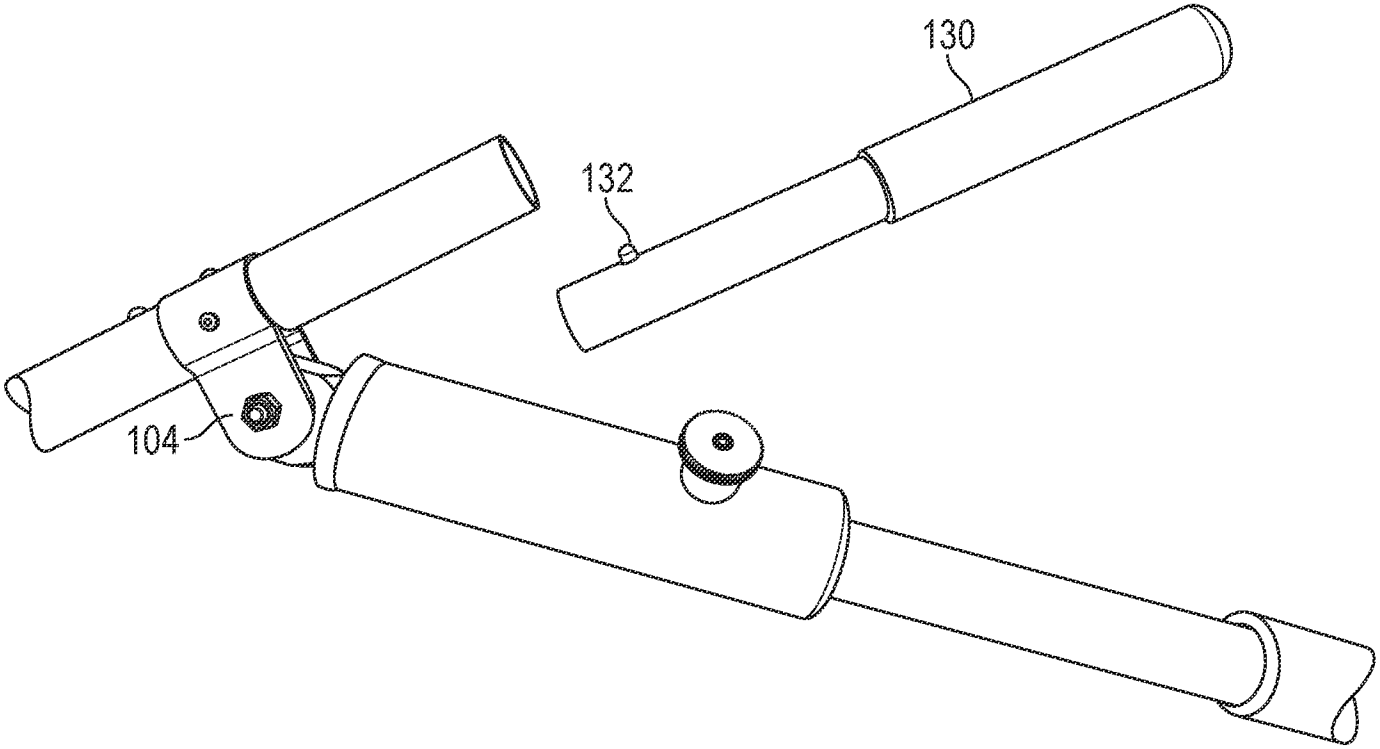
FIGS. 4A-4I illustrate a fourth apparatus for human balance training in accordance with some embodiments.
Figure 4B:
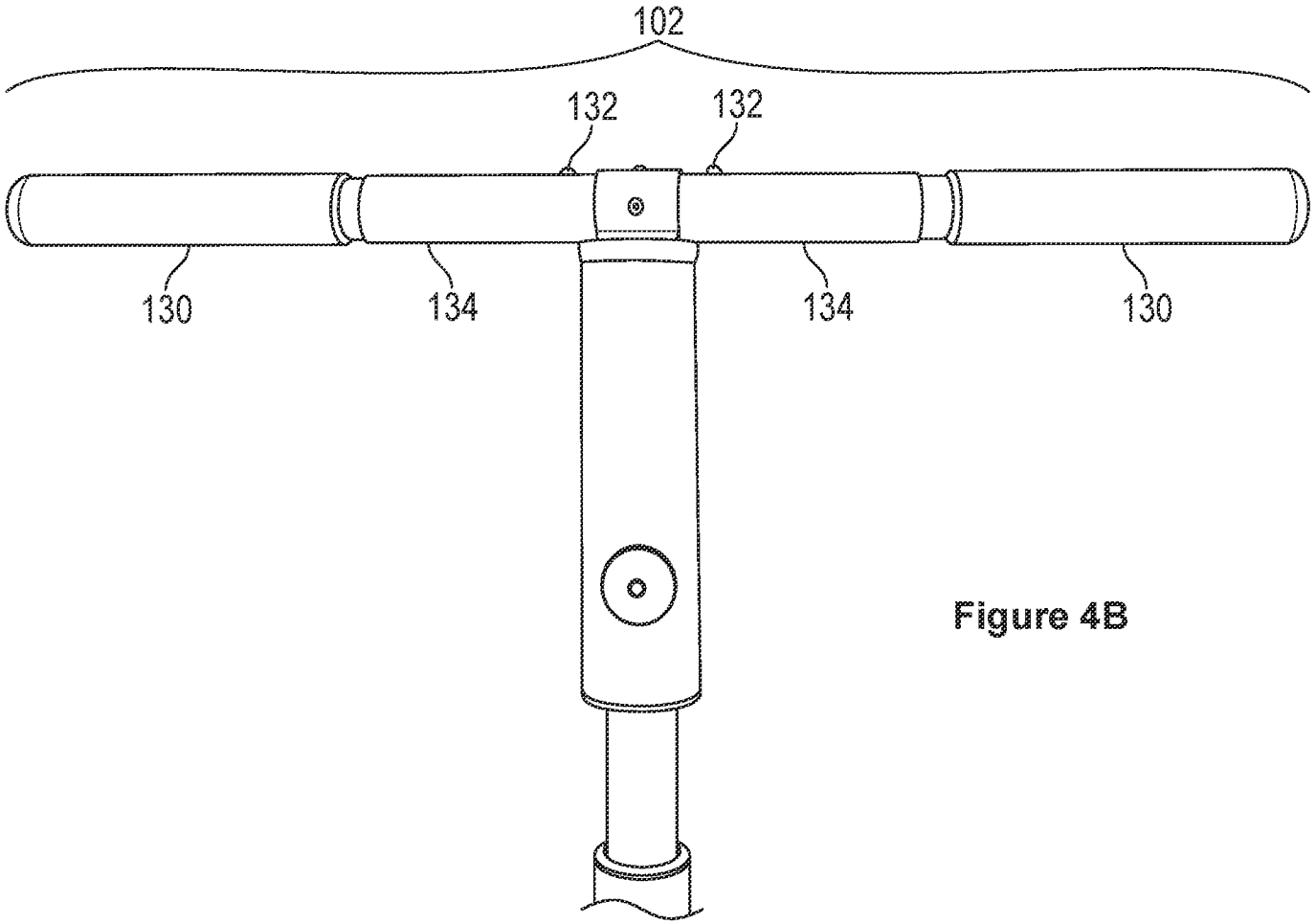
Figure 4C:
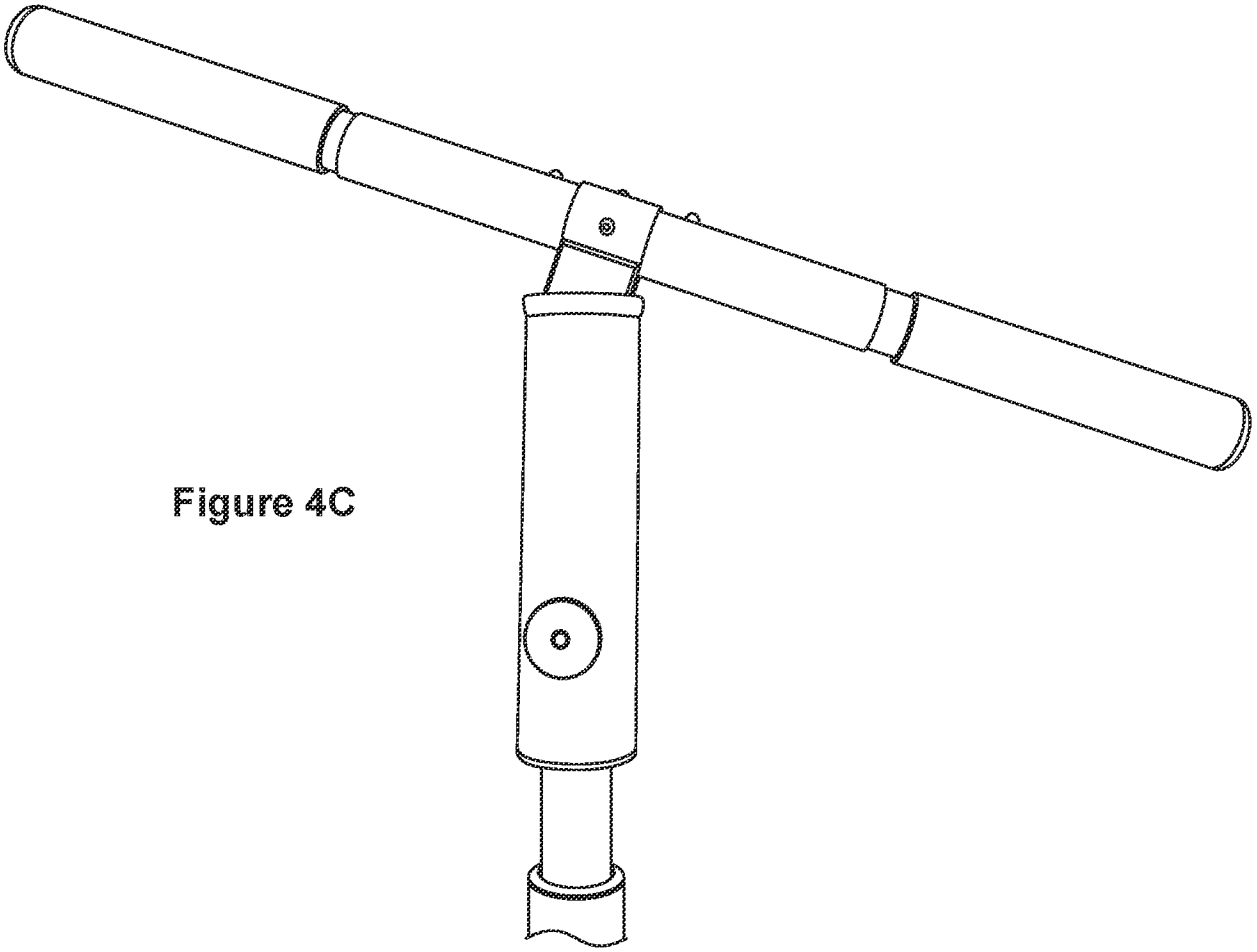
Figure 4D:
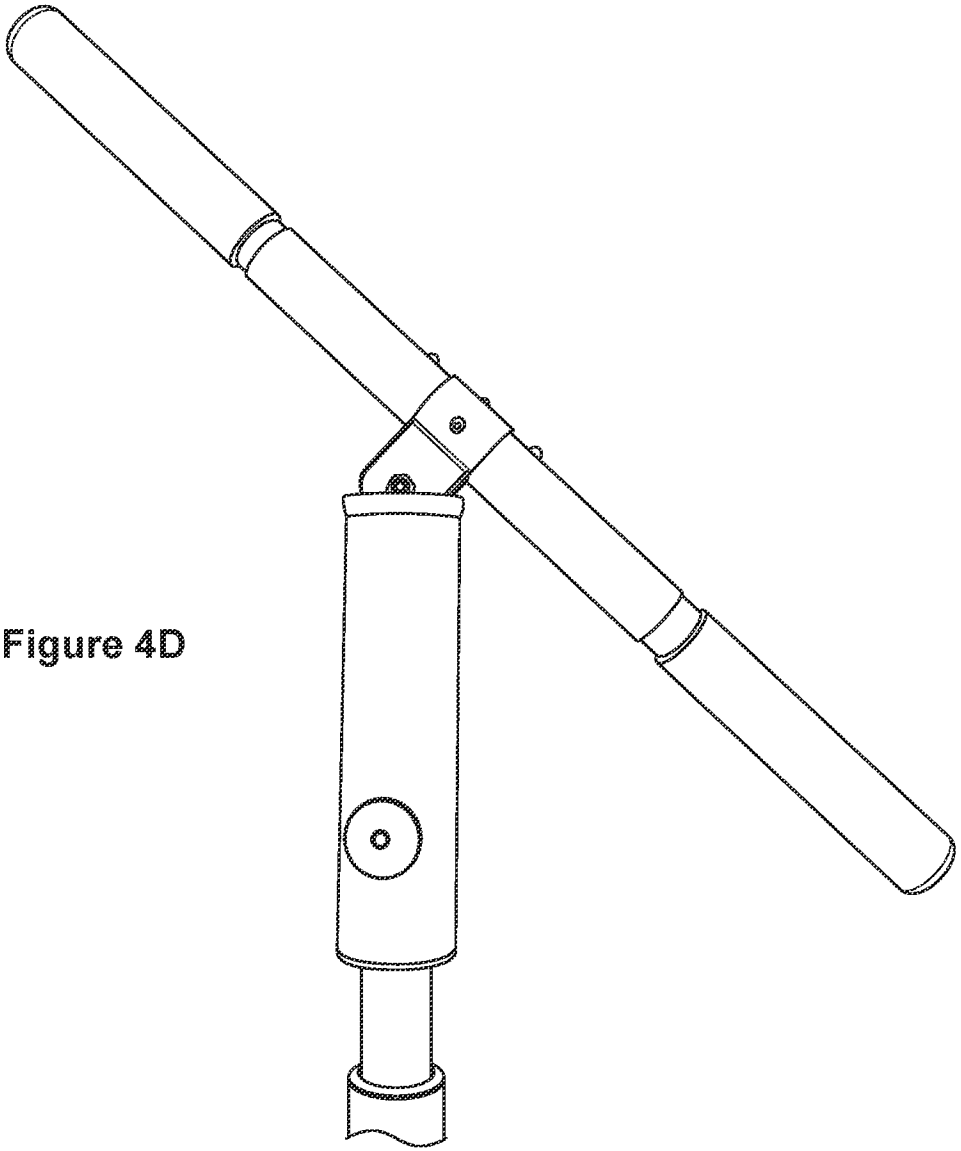
Figure 4E:
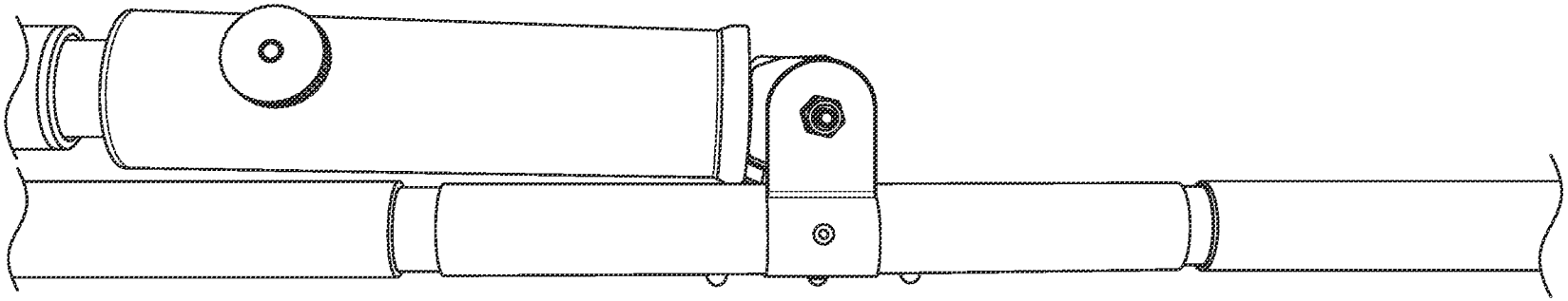

FIGS. 4A and 4B illustrate that the cross bar 102 may consist of multiple portions. In this case, the cross bar 102 includes a central portion 134 and two handles 130. The handles 130 are inserted into the central portion 134 and held in place by spring buttons 132. FIGS. 4C-4E illustrate tilting of the cross bar.

Figure 4F:
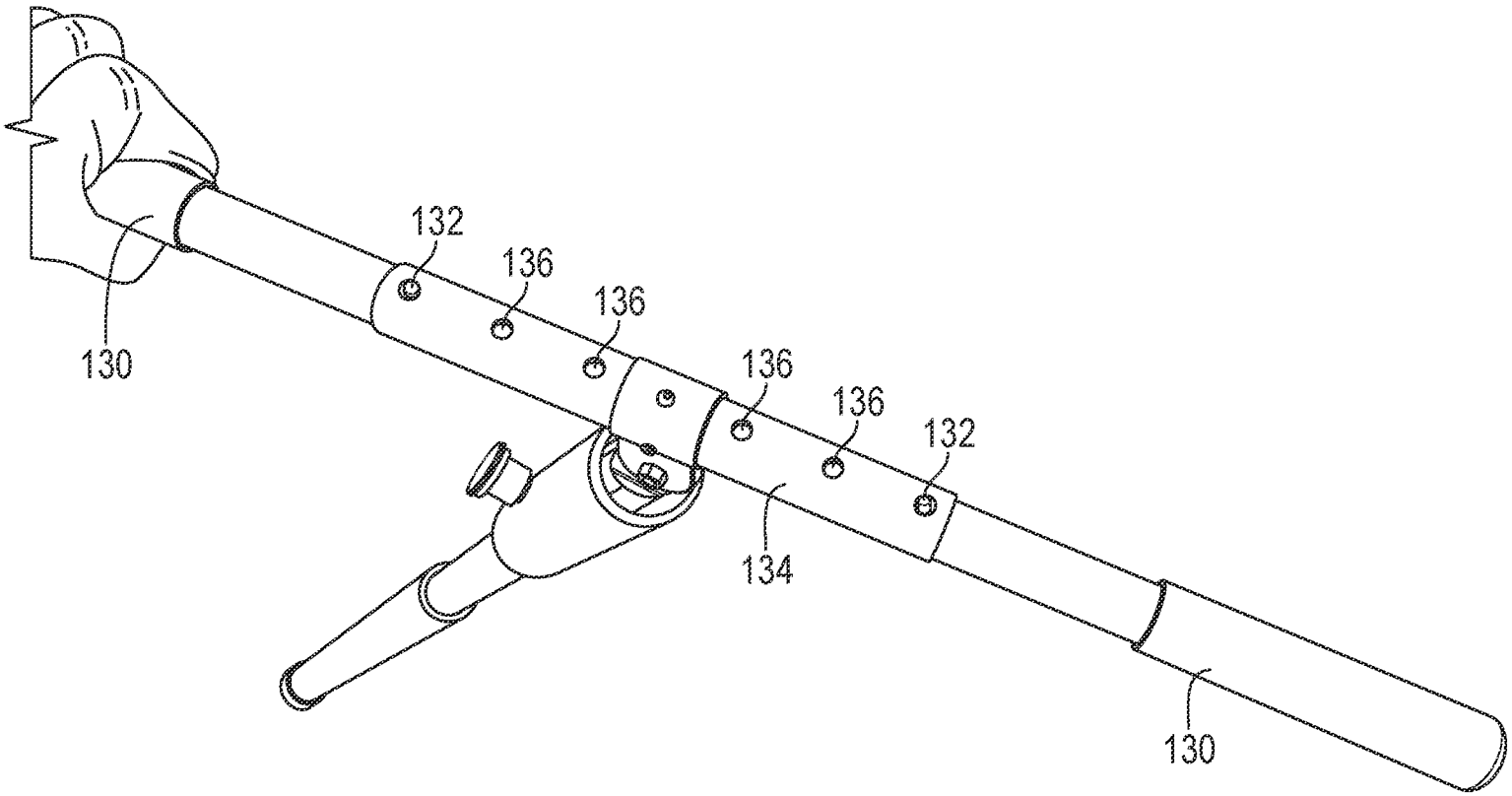
Figure 4G:
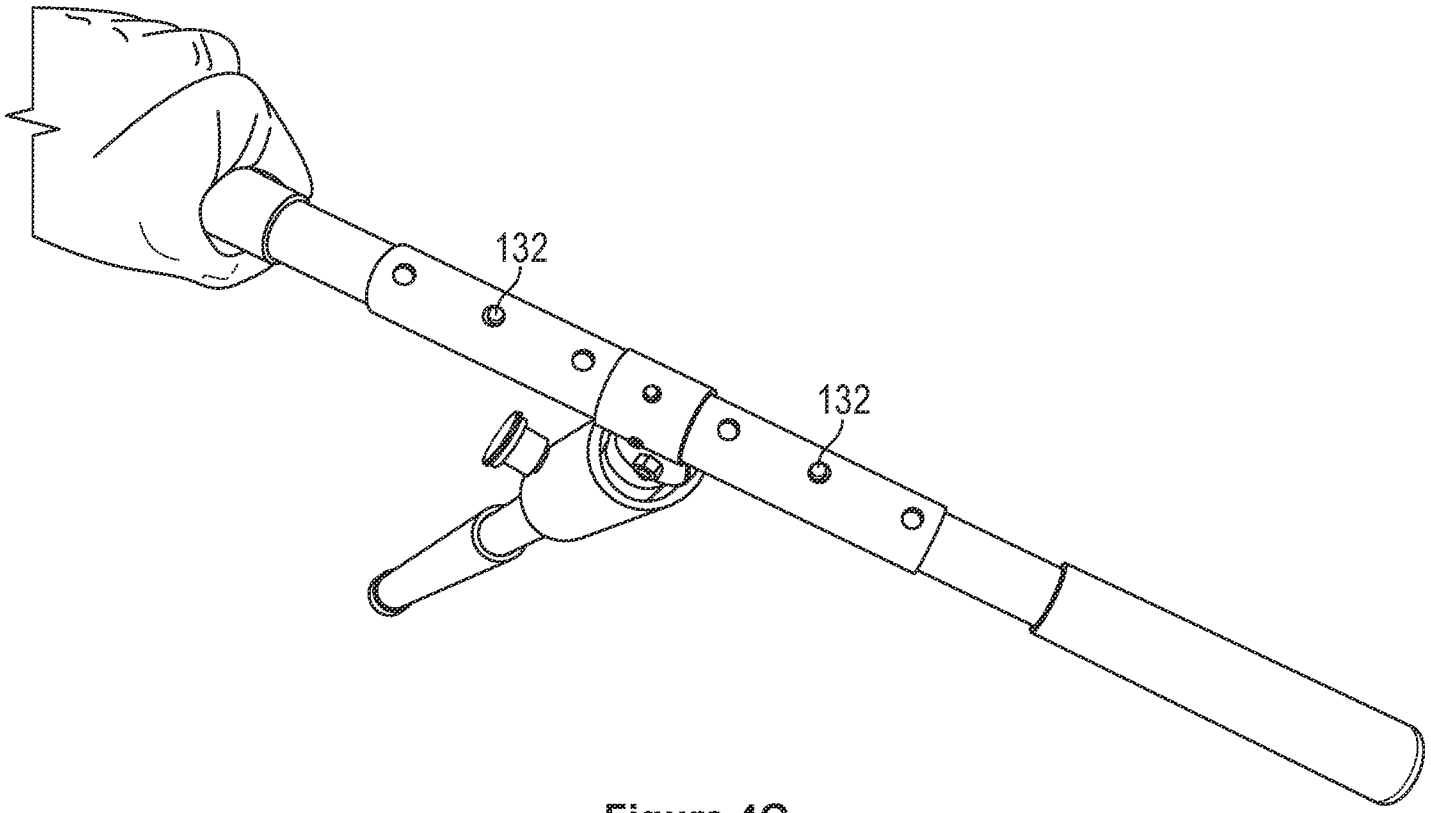

FIGS. 4F and 4G provide top views of the apparatus, showing the handles 130 and the central portion 134. FIGS. 4F and 4G also illustrate the openings 136 that engage with the spring buttons 132 to secure the handles to the central portion 134.

Figure 4H:
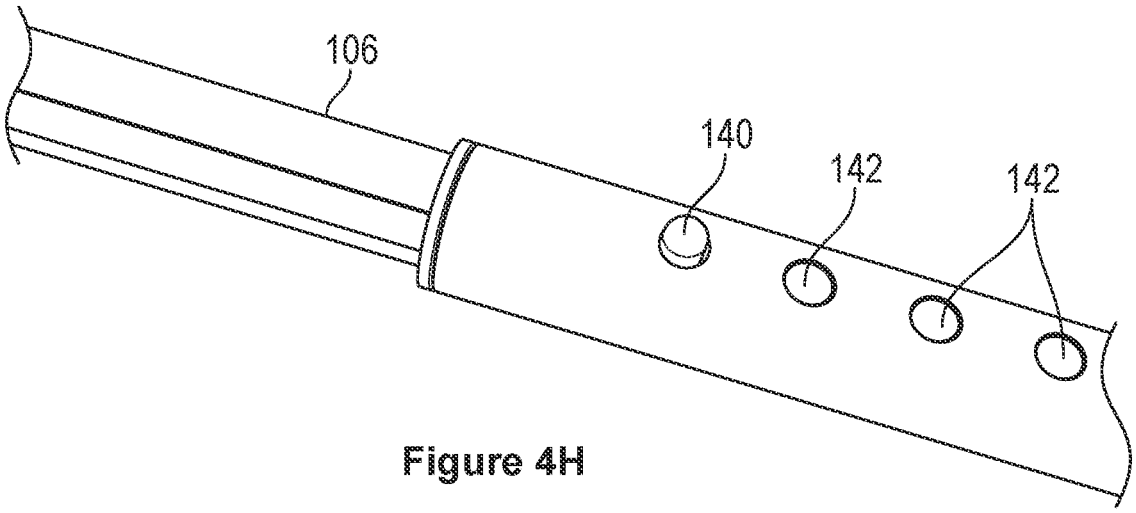

FIG. 4H shows a close up view of the spring lock mechanism used to adjust the length of the leg 106 in some embodiments. A spring button 140 presses into one of the openings 142 to hold the leg together at a desired length.

Figure 4I:
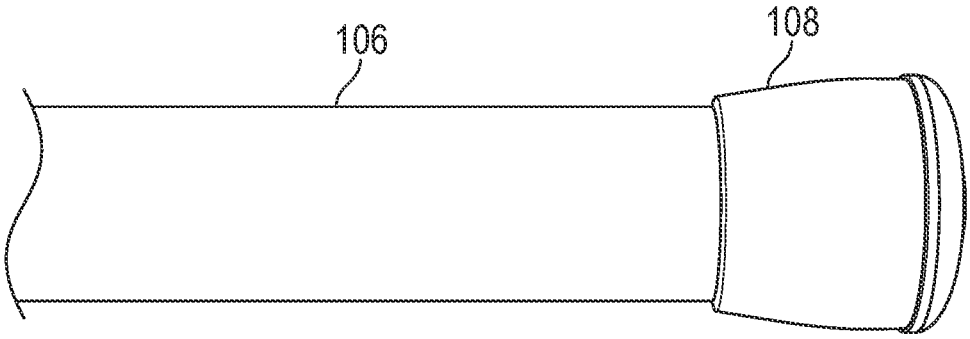

FIG. 4I illustrates a simple cap base 108 used in some embodiments. The cap may be composed of plastic, rubber, or other material suitable to grip floor surfaces, or a combination of materials whose bottom surface provides adequate friction so that the apparatus 100 does not slip while in use.

FIGS. 5A-5E illustrate a fifth apparatus for human balance training in accordance with some embodiments. In this embodiment, there is an upper protective ring 154, which has a larger diameter than the rest of the sheath 110. This provides a sturdy surface to prevent the cross bar from tilting further than desired. The sturdy upper protective ring also maintains the structural integrity of the sheath so that it can last longer under normal use. Because the apparatus is used as a tool for balance training, some users may exert a considerable force on the cross bar, pressing it against the upper part of the sheath. The reinforcement ring 154 protects the sheath against damage.

The embodiment in FIGS. 5A-5E also has a lower ring 150, which defines the lower limit of where the sheath can slide. Some include a written scale 156 on the leg 106 right above the lower ring. The scale indicates the tilt angular range based on the location of the bottom of the sheath. Some embodiments include a lower sheath ring 152. In some embodiments, the lower sheath ring identifies the tilt angular range on the scale 156 (e.g., using a window 158 in the lower sheath ring). In some embodiments, the lower sheath ring is a means of releasing the sheath from the current locked position, enabling it to move vertically. In some embodiments, the release operation is performed by squeezing two opposing portions of the lower sheath ring 152 together.

In some embodiments, the sheath is threaded with respect to the leg 106, and movement of the sheath 110 vertically is performed by rotating the sheath around the leg. In some embodiments, there is a separate locking mechanism (e.g., the lower sheath ring 152), and the sheath can be rotated with respect to the leg only when the sheath is in a released state. In some embodiments, "locking" of the sheath is achieved mechanically by the threading of the sheath with respect to the leg. Because the motion of the cross bar 102 does not generally create a rotational force on the sheath 110, the sheath 110 is able to hold its position.

Figure 5A:
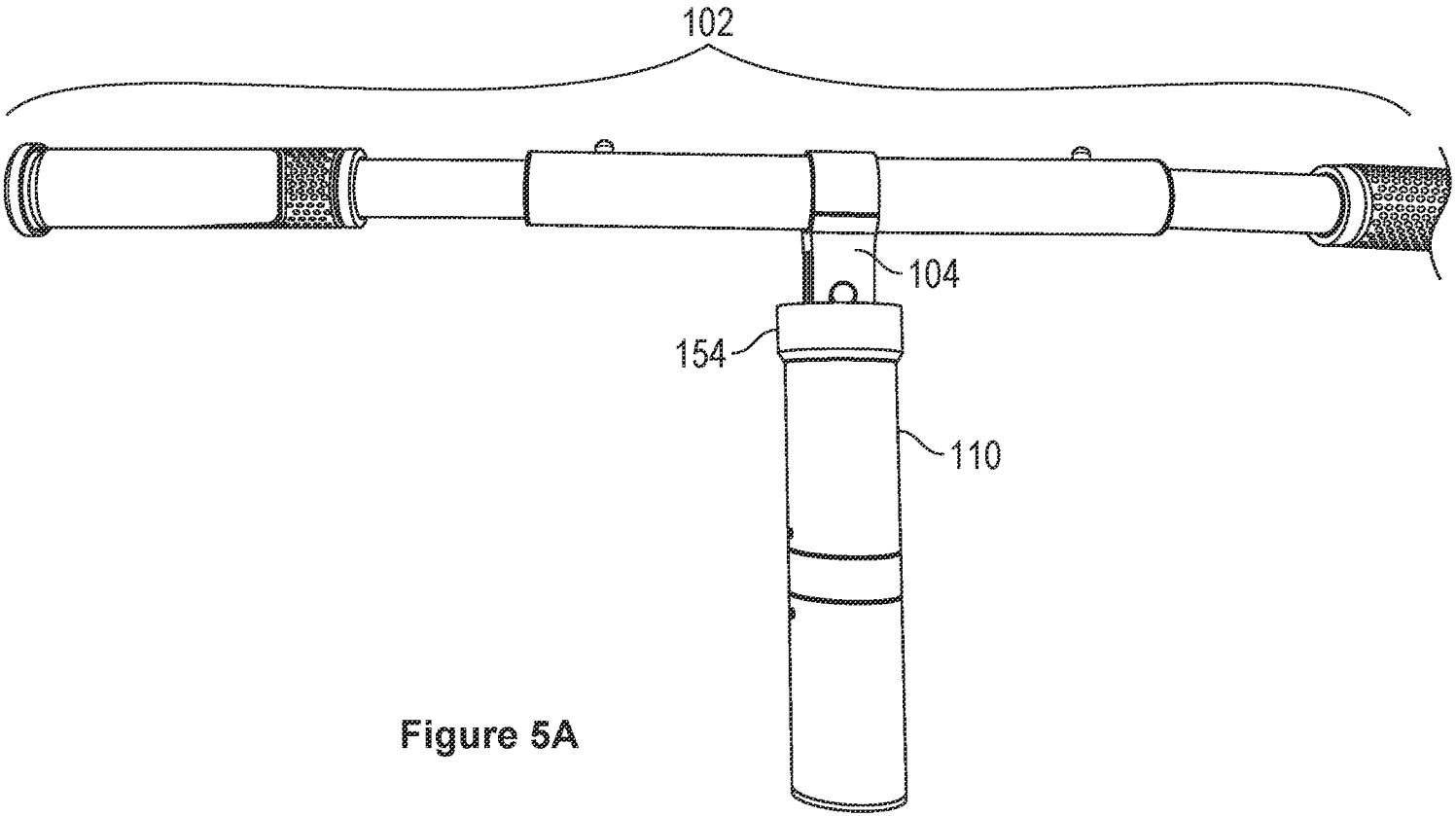
FIGS. 5A-5E illustrate a fifth apparatus for human balance training in accordance with some embodiments.
Figure 5B:
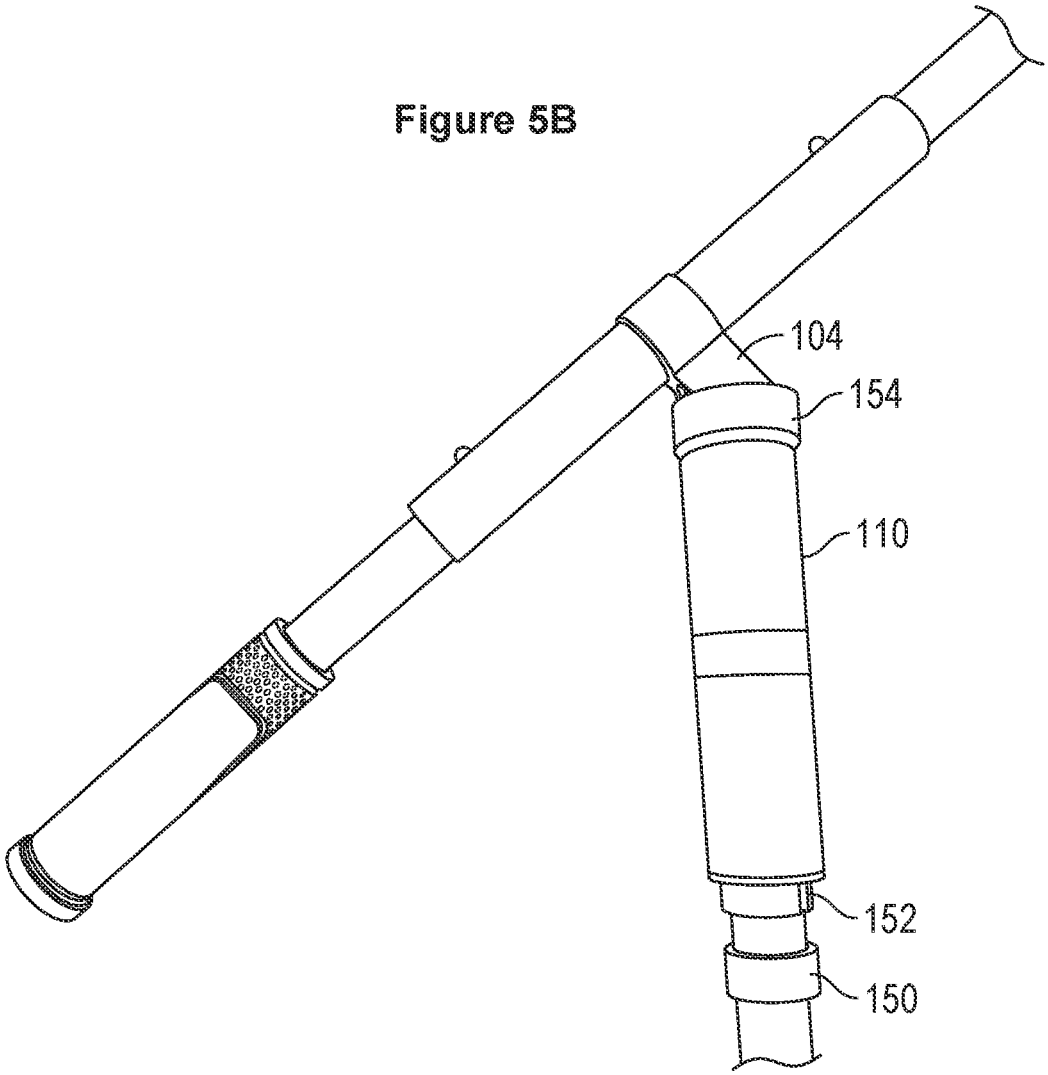
Figure 5C:
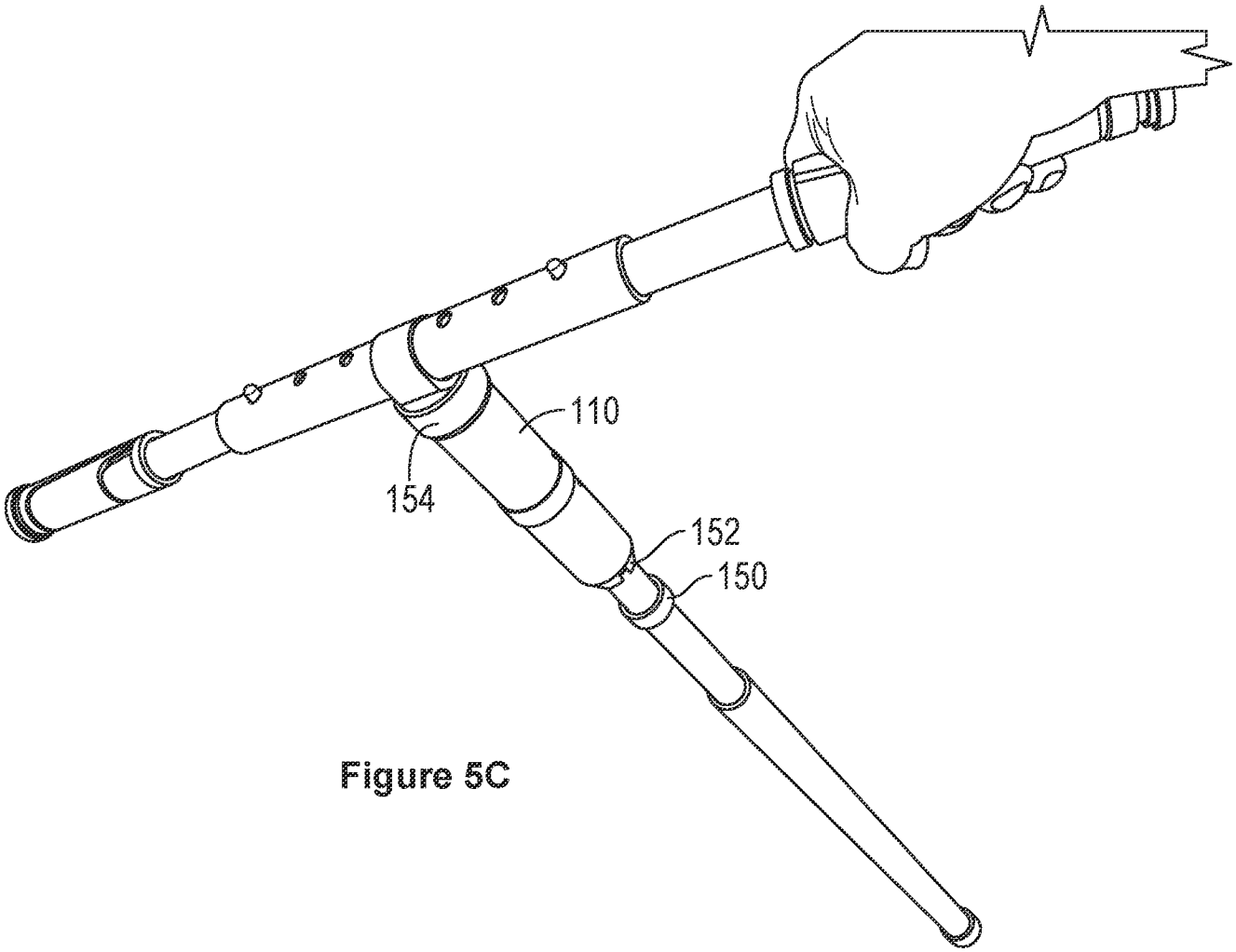
Figure 5D:
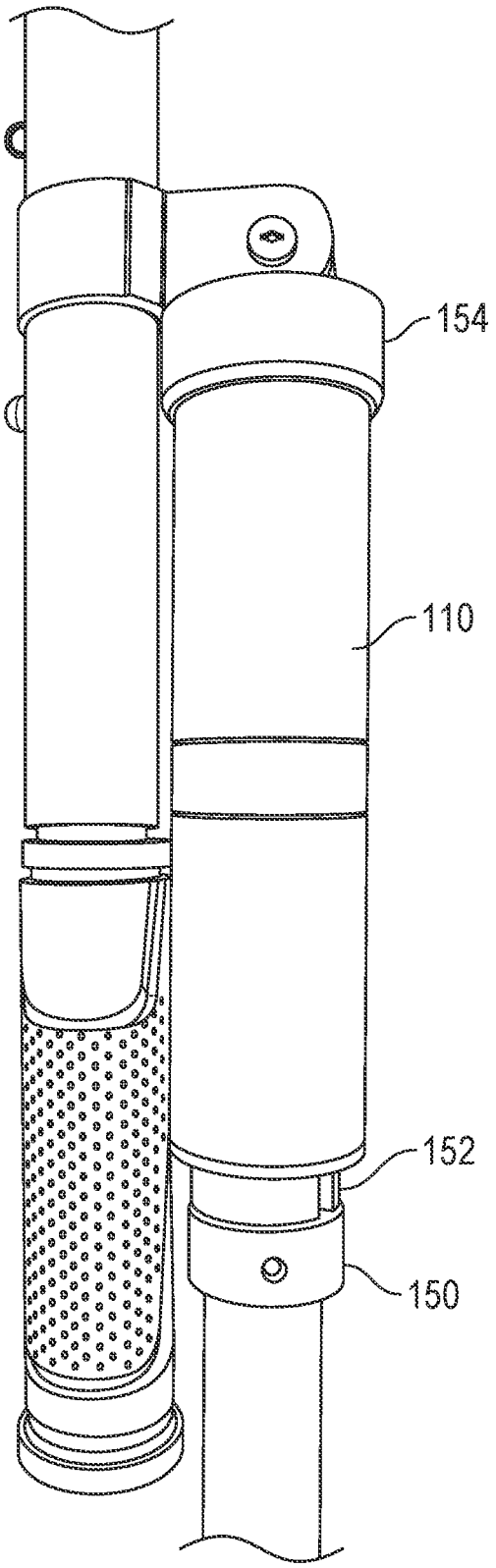
Figure 5E:
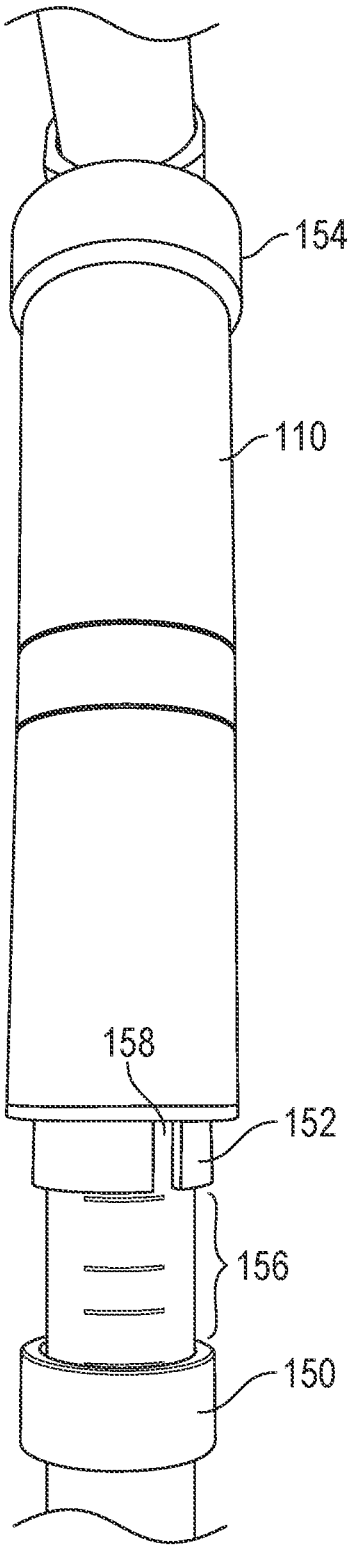
Figure 6A:
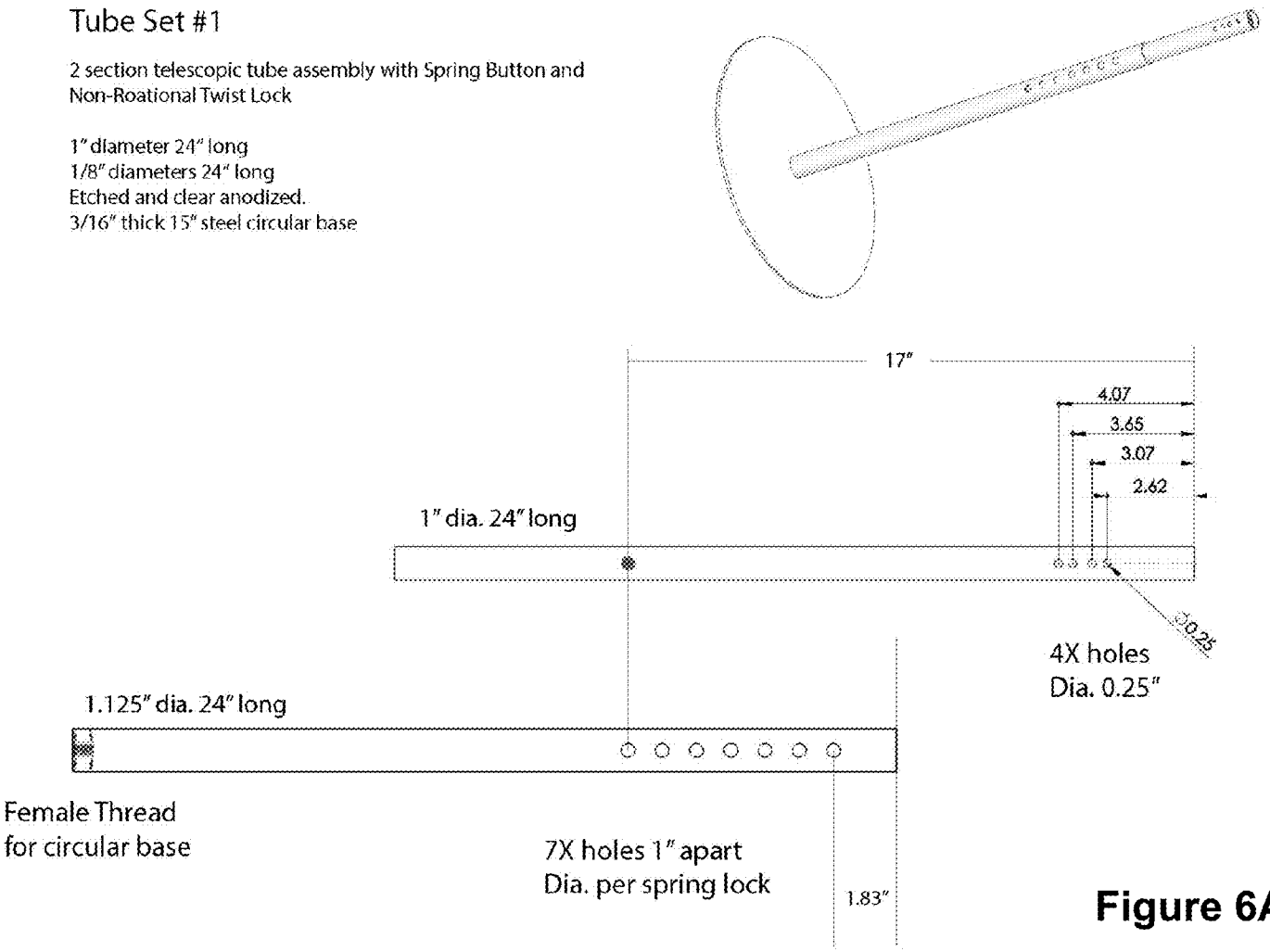
FIGS. 6A-6D, 7, and 8 illustrate come components of an apparatus for human balance training in accordance with some embodiments.
Figure 6B:
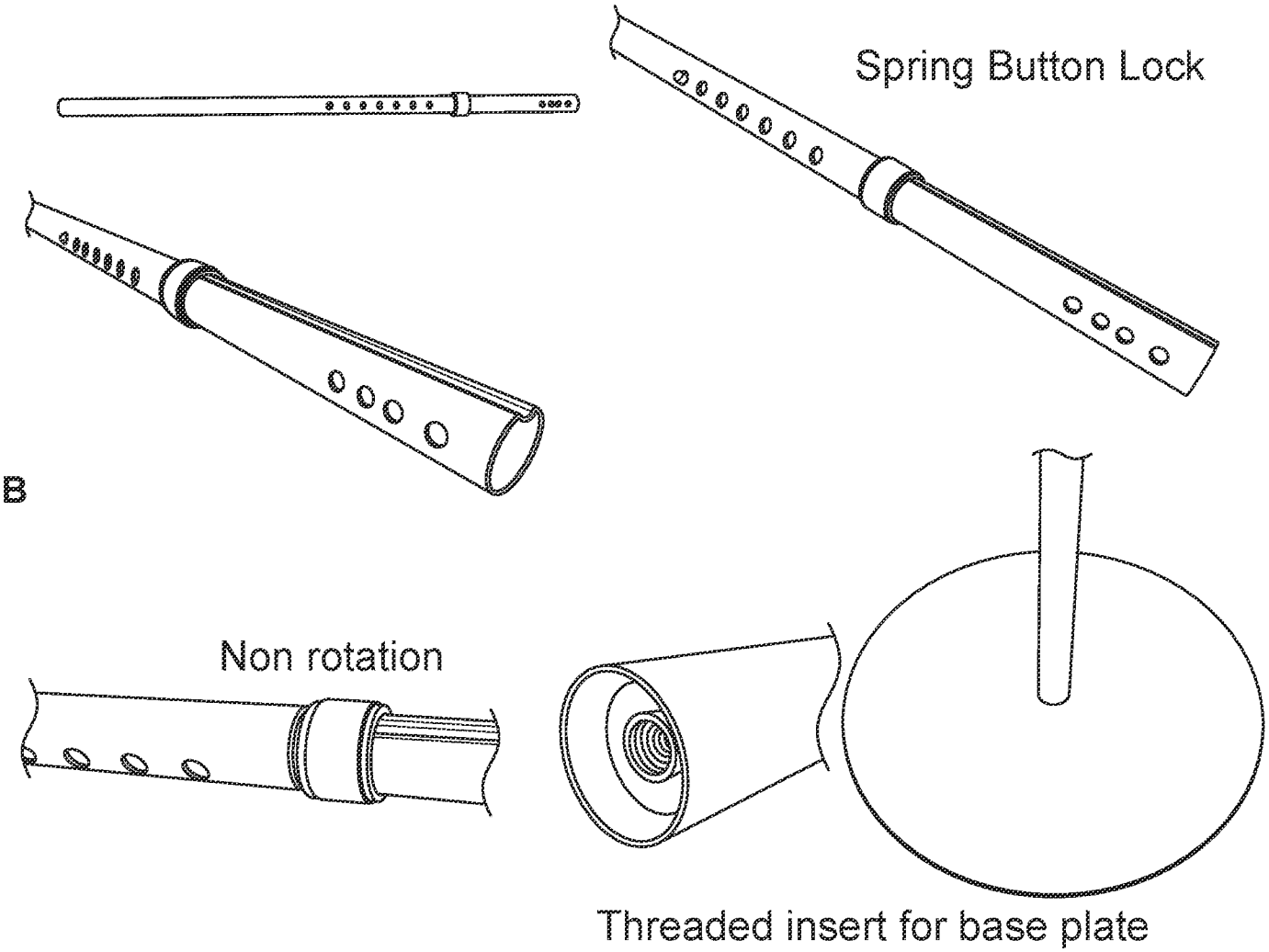
Figure 6C:
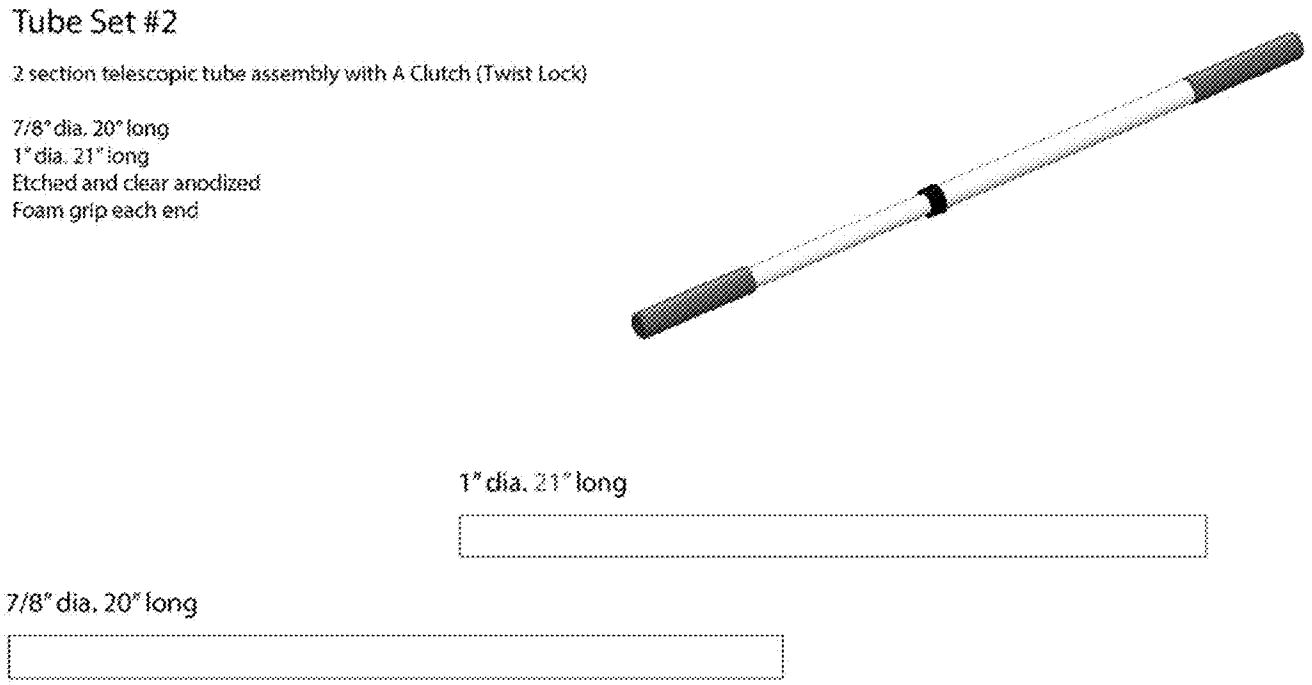
Figure 6D:
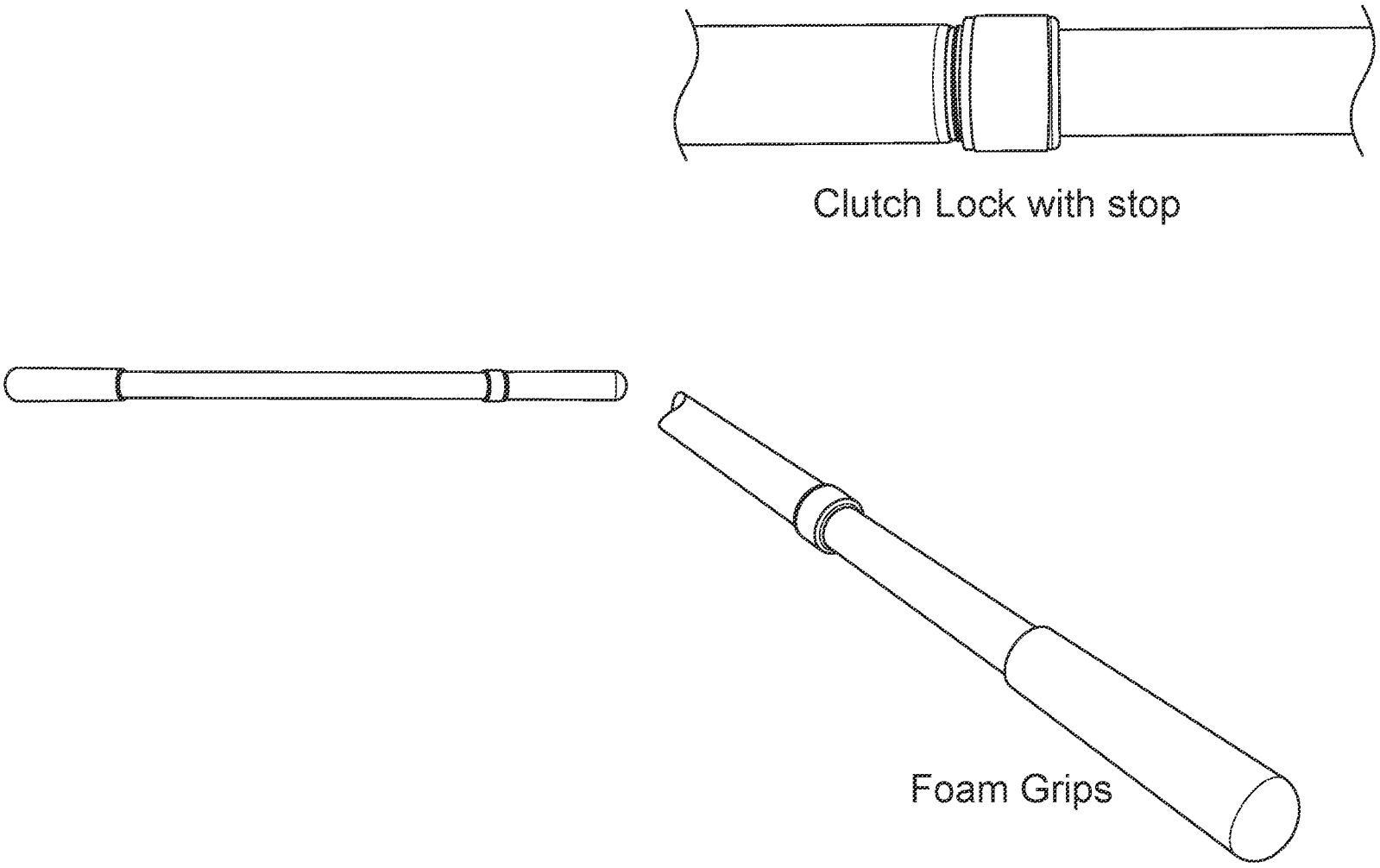

FIG. 5C illustrates the state where the sheath 110 is at its highest point, forcing the cross bar to be horizontal. FIG. 5D illustrates the state where the sheath is at its lowest point, enabling the cross bar 102 to have 90 degrees of angular range.

Figure 7:
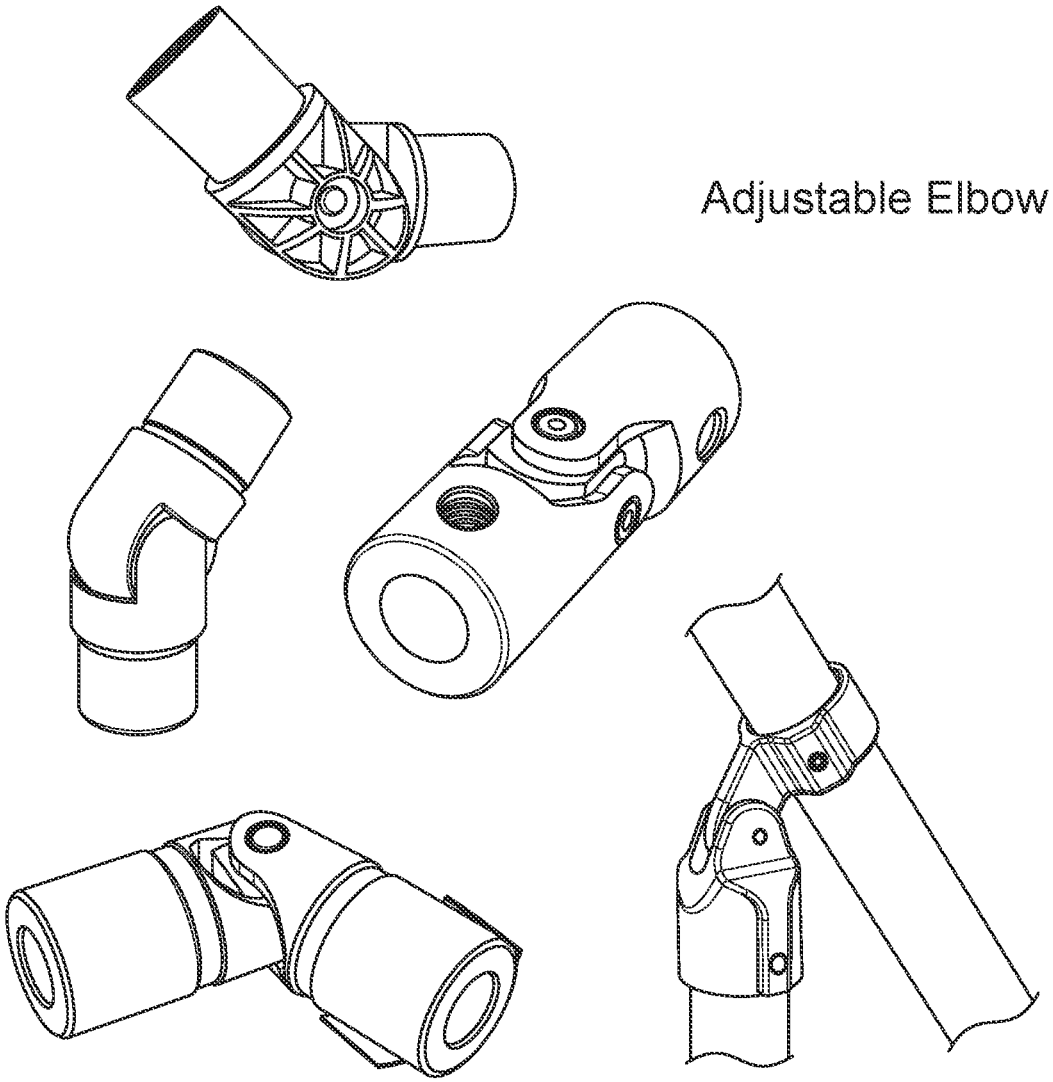
Figure 8:
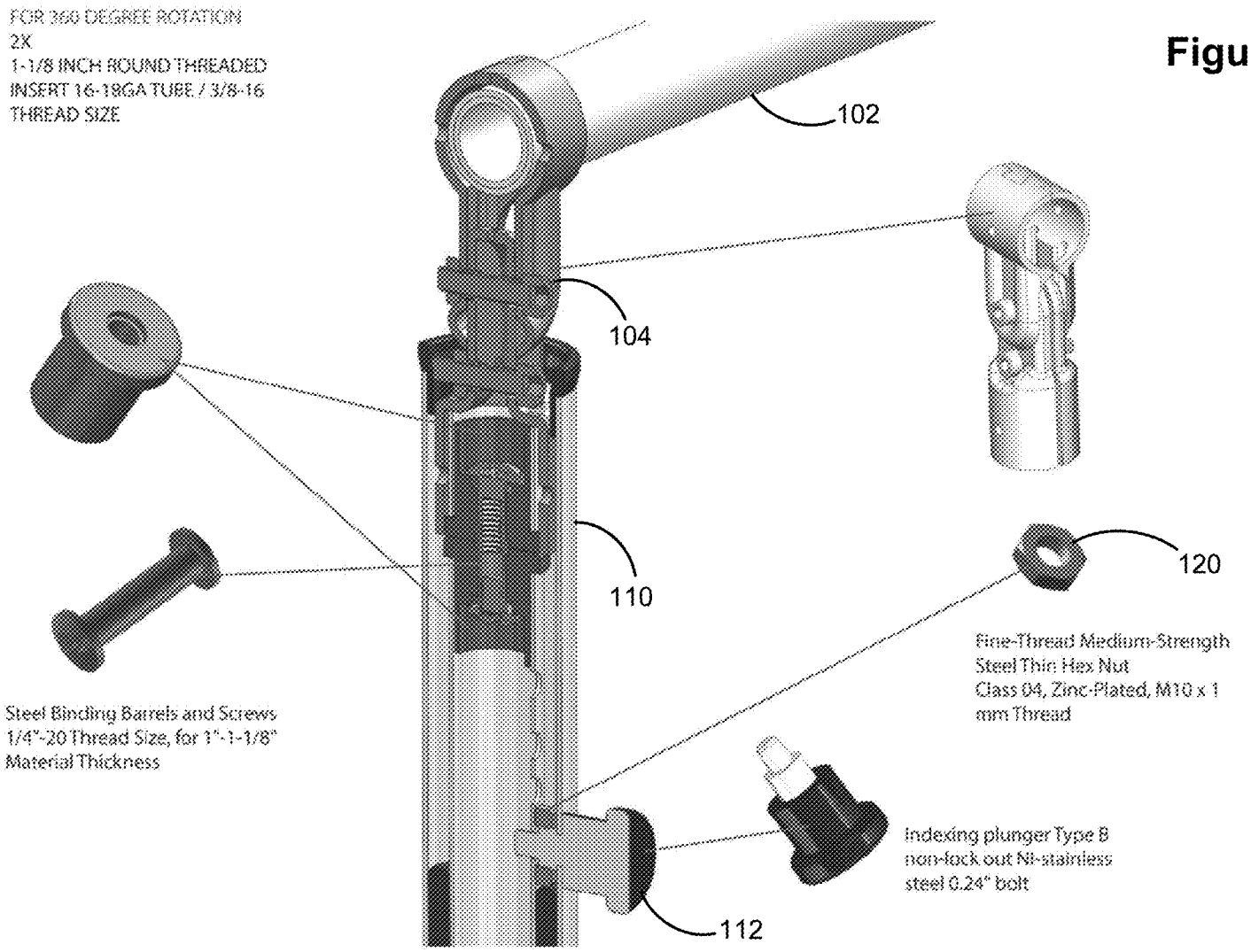

FIGS. 6A-6D, 7, and 8 illustrate some components of an apparatus for human balance training in accordance with some embodiments. FIGS. 6A-6D illustrate the tubes that are used in some embodiments. FIG. 7 illustrates various elbow joint components that are used for the pivotable protrusion 104 in some embodiments. FIG. 8 illustrates some of the components used inside the sheath according to some embodiments.

Various features of an apparatus for balance training have been described with respect to certain embodiments. One of ordinary skill in the art would recognize that features can be combined in many ways, and are not limited to the specific embodiments in which they are described. For example, any of the cross bar implementations can be combined with any of the sheath implementations, and these can be combined with any of the base implementations. Unless physically incompatiable, any combination of the disclosed features may be used to form an apparatus for human balance training as described herein. The scope of coverage is defined by the claims below.

The terminology used in the description of the various described embodiments herein is for the purpose of describing particular embodiments only and is not intended to be limiting. As used in the description of the various described embodiments and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, steps, operations, elements, and/or components, but do not preclude the presence or addition of one or more other features, steps, operations, elements, components, and/or groups thereof.

While preferred materials for elements have been described, the device is not limited by these materials. Plastics, rubbers, metals, woods, and other materials may comprise some or all of the elements of the various embodiments.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A mechanical apparatus for human balance training, the apparatus comprising:

a vertically oriented leg having a first end;

a pivotable protrusion having a second end and a third end that is opposite to the second end, the second end of the pivotable protrusion pivotably coupled to the first end of the leg;

a sheath surrounding a portion of the leg proximate to the first end, the sheath configured to (i) move along a length of the leg proximate to the first end and (ii) secure to the leg at a plurality of positions, wherein the sheath surrounds at least a portion of the pivotable protrusion for at least a subset of the plurality of positions; and a cross bar having a center that is fixedly coupled to the third end of the pivotable protrusion to form a T-shape structure, the T-shape structure configured to tilt at the second end of the pivotable protrusion, wherein during use of the mechanical apparatus:

the sheath secures to the leg at a respective position, of the plurality of positions, such that the respective position (i) controls a respective extent by which the pivotable protrusion protrudes out from the sheath; and (ii) enables tilting of the T-shape structure, at the second end of the pivotable protrusion, over a corresponding angular range that is determined by the respective extent by which the pivotable protrusion protrudes out from the sheath.

2. The mechanical apparatus of claim 1, wherein:

the sheath includes a first thread on an inner surface of the sheath;

the leg includes a second thread on an outer surface of the leg;

the sheath is configured to secure to the leg via engagement between the first thread and the second thread; and the plurality of positions comprises a continuous range of positions adjusted by twisting the sheath relative to the leg.

3. The mechanical apparatus of claim 1, wherein the plurality of positions comprises a finite plurality of predefined locking positions, each of the locking positions limiting tilt of the cross bar to a respective predefined angular range with respect to the leg.

4. The mechanical apparatus of claim 3, wherein each locking position corresponds to a respective opening in the sheath, and the sheath engages the respective locking position when a mechanical button on the leg presses into the respective opening.

5. The mechanical apparatus of claim 3, wherein each locking position corresponds to a respective opening in the leg, and the sheath engages the respective locking position when a knob on the sheath is inserted into the respective opening.

6. The mechanical apparatus of claim 5, wherein each opening in the leg is threaded, and the sheath engages the respective locking position by twisting the knob along an axis perpendicular to the respective opening.

7. The mechanical apparatus of claim 1, wherein each angular range is between 0° and 90°.

8. The mechanical apparatus of claim 1, wherein the pivotable protrusion is rotatably coupled to the leg, enabling the cross bar to rotate about an axis defined by the leg.

9. The mechanical apparatus of claim 8, wherein the leg includes a tension screw that controls how freely the cross bar can be rotated.

10. The mechanical apparatus of claim 1, wherein the cross bar is rotatably coupled to the third end of the pivotable protrusion, enabling the cross bar to rotate in a plane perpendicular to an axis of the attached pivotable protrusion.

11. The mechanical apparatus of claim 1, wherein the cross bar includes a pair of telescoping handles at opposing ends of the cross bar.

12. The mechanical apparatus of claim 1, wherein the pivotable protrusion includes an elbow joint or a ball joint.

13. The mechanical apparatus of claim 12, wherein the leg comprises a first portion that telescopes relative to a second portion of the leg.

14. The mechanical apparatus of claim 13, wherein the first portion has a plurality of openings, each opening corresponding to a respective leg locking position, and the respective leg locking position is engaged when a mechanical button on the second portion of the leg presses into the respective opening in the first portion.

15. The mechanical apparatus of claim 1, wherein the leg has an adjustable length.

16. The mechanical apparatus of claim 15, wherein the length of the leg is adjusted according to a plurality of leg locking positions.

17. The mechanical apparatus of claim 1, further comprising a latch attached to the leg, wherein the cross bar can be detachably coupled to the latch when the sheath is in a position that provides an angular range of 90°.

18. The mechanical apparatus of claim 1, wherein the leg includes a second end opposite to the first end, and the second end is coupled to a cap comprising a material having a high coefficient of static friction.

19. The mechanical apparatus of claim 1, further comprising:

a base perpendicular to the leg, wherein the base comprises either (i) a disc or (ii) at least two elongated members.

20. The mechanical apparatus of claim 1, wherein the sheath is configured to move along the length of the leg proximate to the first end via a translational movement or a spiral movement.

* * * * *